US005353011A

United States Patent [19]

Wheeler et al.

[11] Patent Number: 5,353,011

[45] Date of Patent: Oct. 4, 1994

[54] ELECTRONIC ARTICLE SECURITY SYSTEM WITH DIGITAL SIGNAL PROCESSING AND INCREASED DETECTION RANGE

[75] Inventors: Richard G. Wheeler, Robbinsville, N.J.; Burton S. Abrams, Wyndmoor, Pa.; Joseph M. Cannon, Mantua, N.J.; Stephen J. Casey, Marlton, N.J.; Luke C. Chang, West Deptford, N.J.; Von C. Ertwine, Langhorne, Pa.; Douglas S. Makofka, Willow Grove, Pa.; Louis A. Mastrocola, Blue Bell, Pa.; Calvin R. Waples, Jr., Swedesboro, N.J.

[73] Assignee: Checkpoint Systems, Inc., Thorofare, N.J.

[21] Appl. No.: 481

[22] Filed: Jan. 4, 1993

[51] Int. Cl.[5] ..... G08B 13/184; G08B 13/181

[52] U.S. Cl. ..... 340/572; 340/556; 340/566

[58] Field of Search ..... 340/572, 552, 556, 566

[56] References Cited

U.S. PATENT DOCUMENTS

| | | | |
|---|---|---|---|
| 4,023,167 | 5/1977 | Wahlstrom | 342/42 |
| 4,382,291 | 5/1983 | Nakauchi | 340/552 |
| 4,512,000 | 4/1985 | Masuko | 340/552 |
| 4,668,942 | 5/1986 | Eccleston et al. | 340/551 |
| 4,686,517 | 8/1987 | Fockens | 340/572 |
| 4,812,822 | 3/1989 | Feltz et al. | 340/572 |
| 4,859,991 | 8/1989 | Watkins et al. | 340/572 |
| 5,023,598 | 6/1991 | Zemlok et al. | 340/572 |
| 5,051,727 | 9/1991 | Fockens | 340/572 |
| 5,103,234 | 4/1992 | Watkins et al. | 343/742 |
| 5,243,183 | 9/1993 | Barron, Jr. | 340/556 |

*Primary Examiner*—Glen Swann

*Attorney, Agent, or Firm*—Panitch Schwarze Jacobs & Nadel

[57] ABSTRACT

An improved electronic article security system is employed for detecting the presence of a security tag within a detection zone. The system includes a transmitter for generating electromagnetic energy and, in the disclosed embodiment, a single antenna for emitting electromagnetic energy received from the transmitter to establish an electromagnetic field within the detection zone and for sensing disturbances within the electromagnetic field, including disturbances resulting from a security tag within the detection zone. A receiver is provided for processing signals from the antenna relating to sensed disturbances and for providing output signals. A data processing and control section analyzes the output signals from the receiver and determines whether a sensed disturbance within the electromagnetic field is caused by the presence of a security tag within the detection zone. The output signals from the receiver are analyzed in accordance with predetermined criteria and pattern recognition techniques based upon receiver output signals which would be expected if a security tag were present in the detection zone to establish a security tag probability percentage.

101 Claims, 10 Drawing Sheets

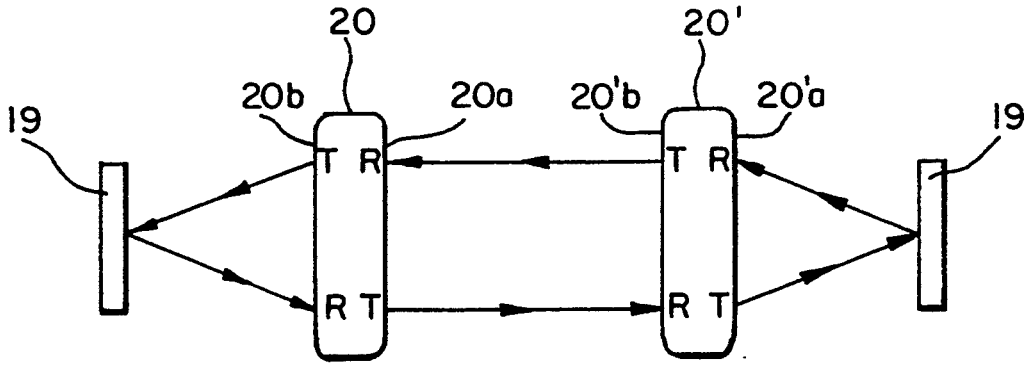
FIG. 12
FIG. 13a
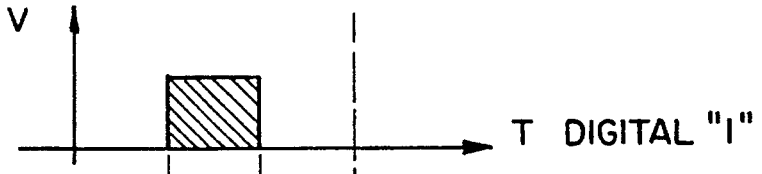
FIG. 13b
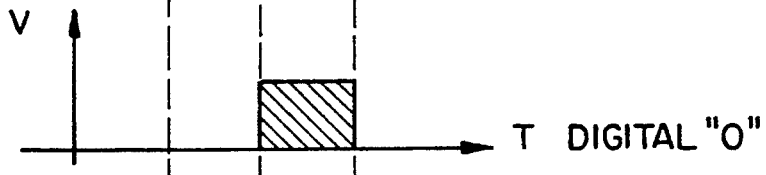
FIG. 13c
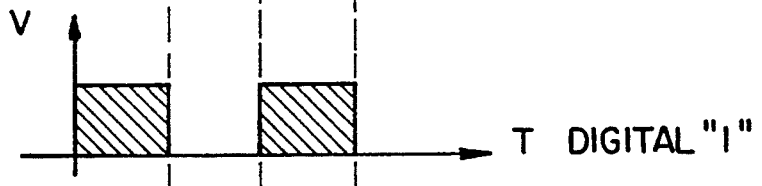
FIG. 13d
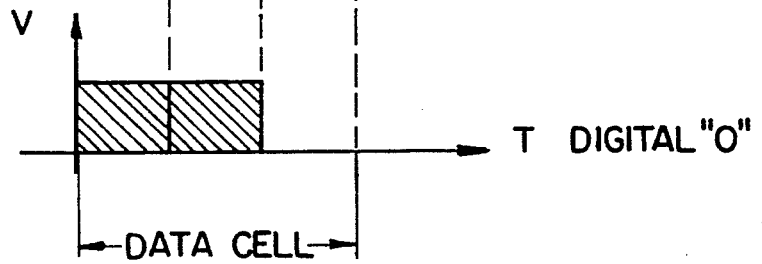

ELECTRONIC ARTICLE SECURITY SYSTEM WITH DIGITAL SIGNAL PROCESSING AND INCREASED DETECTION RANGE

BACKGROUND OF THE INVENTION

The present invention relates generally to electronic article security-systems for detecting the presence of a security tag within a detection zone and, more particularly, to an improved electronic article security system which provides enhanced reliability over a larger detection zone.

Electronic article security systems for detecting and preventing theft or unauthorized removal of articles or goods from retail establishments and/or other facilities, such as libraries, has become widespread. In general, such security systems employ a security tag which is secured to or associated with an article (or its packaging), typically an article which is readily accessible to potential customers or facility users and, therefore, is susceptible to unauthorized removal. Security tags may take on many different sizes, shapes and forms depending upon the particular type of electronic article security system in use, the type and size of the article to be protected, the packaging for the article, etc. In general, such electronic article security systems are employed for detecting the presence (or the absence) of a security tag and, thus, a protected article within a surveilled security area or detection zone. In most cases, the detection zone is located at or around an exit or entrance to the facility or a portion of the facility.

One type of electronic article security system which has gained widespread popularity utilizes a security tag which includes a self-contained, passive resonant circuit in the form of a small, generally planar printed circuit which resonates at a predetermined detection frequency within a detection frequency range. A transmitter, which is also tuned to the detection frequency, is employed for transmitting electromagnetic energy into the detection zone. A receiver, also tuned to the detection frequency, is positioned proximate to the detection zone. Typically, the transmitter and a transmitter antenna are located on one side of an exit or aisle and the receiver and a receiver antenna are located on the other side of the exit or aisle, so that a person must pass between the transmitter and receiver antennas in order to exit the facility. When an article having an attached security tag moves into or passes through the detection zone, the security tag is exposed to the transmitted energy, resulting in the resonant circuit of the tag resonating to provide an output signal detectable by the receiver. The detection of such an output signal by the receiver indicates the presence of an article with a security tag within the detection zone and the receiver activates an alarm to alert appropriate security or other personnel.

While existing electronic article security systems of the type described above and of other types have been shown to be effective in preventing the theft or unauthorized removal of articles, particularly articles which are relatively high in value and relatively small in size, such systems, due to environmental and regulatory considerations, have a relatively limited range. Typically, the range of such prior art systems is on the order of a maximum of about three feet between the transmitter antenna and the receiver antenna. If the antennas are separated by a greater distance, the reliability of such existing electronic article security systems significantly diminishes. More specifically, as the distance between the transmitter antenna and the receiver antenna increases beyond three feet, the ability of such existing electronic article security systems to accurately detect the presence of a security tag within the detection zone and consistently avoid the generation of "false positives" (generating an alarm when no security tag is present in the detection zone) a high percentage of the time greatly decreases. While, such existing, limited size detection zone electronic article security systems are adequate in applications having limited entrance and exit areas, for example, stores or libraries having only a single entrance door, such systems are not as effective in applications having wide entrance areas or aisles, such as large retail stores having eight, ten or more doors arranged side by side or, in the case of large mall stores, having a generally open area of ten feet or more at the front of the store. Sometimes, in such wide aisle or wide entrance/exit applications, multiple electronic article security systems are connected or networked together in a row across the facility entrance. However, such arrangements sometimes result in congestion and are not aesthetically pleasing.

The present invention comprises an electronic article security system which is particularly well adapted for providing a larger (wider) detection zone (six feet or more) and which function in a very reliable manner.

SUMMARY OF THE INVENTION

Briefly stated, the present invention comprises an electronic article security system for detecting the presence of a security tag within a detection zone. The system comprises transmitter means for generating electromagnetic energy and antenna means for emitting electromagnetic energy received from the transmitter means to establish an electromagnetic field within the detection zone and for sensing disturbances within the electromagnetic field, including disturbances resulting from a security tag within the detection zone. Receiver means are provided for processing signals from the antenna means relating to sensed disturbances and for providing output signals. Data processing and control means analyze the output signals from the receiver means and determine whether a sensed disturbance within the electromagnetic field is caused by the presence of a security tag within the detection zone. The data processing and control means comprises means for analyzing the output signals from the receiver means in accordance with predetermined criteria and pattern recognition techniques based upon receiver output signals which would be expected if a security tag were present in the detection zone and for establishing for the receiver output signals a security tag probability percentage.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred, it being understood, however, that the invention is not limited to the precise arrangements and instrumentalities disclosed. In the drawings:

FIG. 12 is a functional schematic diagram illustrating two electronic article security systems operating in a master/slave relationship; and FIGS. 13*a*–13*d* illustrate a preferred digital format for communication between the electronic article security systems of FIG. 12.

DETAILED DESCRIPTION OF PREFERRED EMBODIMENT

Figure 1:
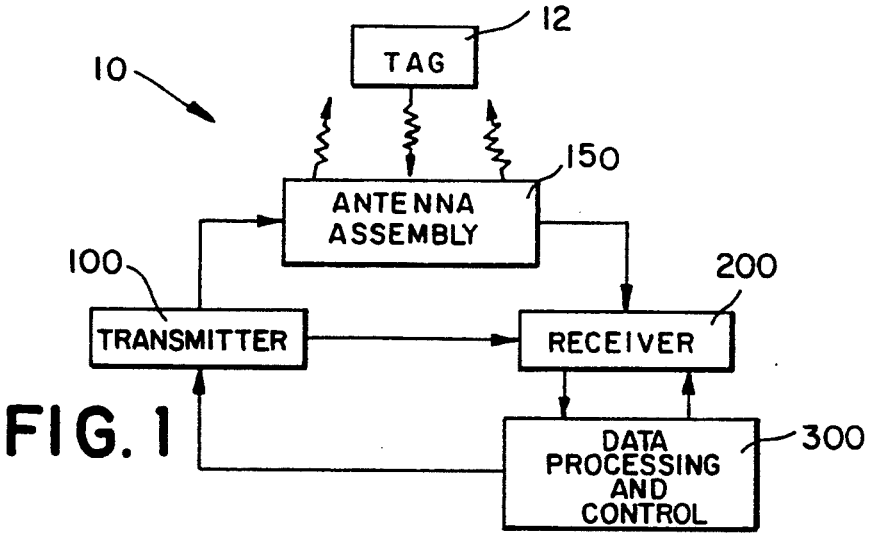
FIG. 1 is a general functional block diagram schematic of an electronic article security system in accordance with a preferred embodiment of the present invention.

Referring to the drawings, wherein the same reference numeral designations are applied to corresponding components throughout the figures, there is shown in FIG. 1 a general functional block diagram schematic of an electronic article surveillance (EAS) or security system 10 in accordance with the present invention. The EAS system 10 is employed for detecting the unauthorized removal of an article (not shown) from a particular area or premises (not shown). Electronic article security systems of the type disclosed have a variety of applications including the prevention of shoplifting of the products from self-service or other retail or wholesale facilities, preventing the unauthorized removal of books or other documents from libraries or document depositories, preventing the unauthorized removal of videotapes from video rental facilities, preventing the unauthorized removal of items from inventory, etc. Electronic article surveillance systems, including the present system 10, employ a device called a transponder, target or security tag 12 which is secured to an article to be protected in either a temporary or permanent fashion so that the security tag 12 moves with the protected article. As with other electronic article surveillance systems, the present system 10 is typically employed at or near the exit of a facility and is positioned in such a manner that a protected article with the security tag 12 attached cannot be removed from the facility without passing through a surveillance or detection zone established by the system 10. The presence of a security tag 12 and, thus, a protected article, within the detection zone of the EAS system 10 is determined by the system and a suitable alarm indication is provided to appropriate security personnel. Protected articles which have been purchased or are otherwise authorized for removal from the facility may have their associated security tags removed or deactivated in order to permit such authorized articles to pass through the detection zone of the system 10 without causing an alarm condition.

In the present embodiment, the EAS system 10 is comprised of a transmitter means or transmitter 100 which generates and transmits an RF electromagnetic energy signal which is employed for detecting the presence of a security tag 12 within the detection zone. In the present embodiment, the transmitter 100 generates an output signal which is swept upwardly and downwardly at a predetermined sweep frequency within a predetermined frequency range. The presently preferred frequency range extends between 7.4 MHz and 9.0 Hz and the preferred sweep rate is 164 Hz.

The output signal from the transmitter 100 is applied to an antenna means or antenna assembly 150 for emitting or broadcasting the RF transmitter output signal into the detection zone to establish an electromagnetic field. Tags 12 include circuitry (not shown) of a type well known to those skilled in the art which, when exposed to an electromagnetic field at a particular frequency or within a particular frequency range (typically the resonant frequency of the tag), generates a disturbance of the electromagnetic field. The antenna assembly 150 in the present embodiment also functions as a receiver antenna for sensing or receiving disturbances created within the electromagnetic field of the detection zone. The functions performed by the antenna assembly 150 could be performed by separate transmit and receive antenna assemblies (not shown) if desired. The output of the receiver portion of the antenna assembly 150 is applied to a receiver means or receiver 200. The receiver 200 functions to detect the presence of a disturbance within the detection zone and to isolate the detected disturbance signal for processing to determine whether a disturbance within the detection zone is due to the presence of a tag 12 or some other source.

In the present embodiment, the output signal from the receiver 200 is provided to a data processing and control means or section 300. The data processing and control section 300 receives the output signal from the receiver 200 and, through a series of processing steps (hereinafter described in greater detail), determines whether or not a sensed disturbance of the electromagnetic field within the detection zone is caused by the presence of a security tag 12 within the detection zone. If the data processing and control section 300 determines that a tag 12 is present in the detection zone and other determinations (hereinafter described) are made, an alarm signal is generated.

The EAS system 10 of the present embodiment may be employed in at least three different configurations or modes of operation, depending upon the size of the area to be protected, i.e., the size of the detection zone. In the first mode of operation, the EAS system 10 is employed by itself as a single unit to provide a detection zone of approximately six feet, three feet on either lateral side of the antenna assembly 150. The EAS system 10 is typically employed in the first mode of operation in conjunction with a facility having only a single relatively narrow (i.e., less than six feet) exit area.

In the second configuration or mode of operation, the exit area or detection zone is greater than six feet but generally less than twelve feet so that complete coverage of the detection zone may be obtained by utilizing two EAS systems 10 which are interconnected. In order to preclude interference between the electromagnetic fields generated by each of the systems and to enhance tag detection range, when two EAS systems 10 are employed, the antenna systems 150 are phased so that the electromagnetic fields which are generated are out of phase and preferably precisely 180° out of phase from each other. One of the EAS systems is designated as the master or controlling system and the other EAS system is designated as the slave or controlled system. The two EAS systems 10 are connected together for proper out of phase operation in a manner described in greater detail hereinafter.

In the third configuration or mode of operation, three or more interconnected EAS systems 10 are employed in a network generally side by side along a single row to provide a wider detection zone. Typically, three or more such systems are employed in a large facility, such as a large retail store having a wide exit aisle, typically wider than twelve feet. If three or more EAS systems 10 are employed, a separate control system or master driver (not shown in FIG. 1) is employed for proper phasing of the respective antenna systems 150 to enhance tag detection range and to prevent interference between the generated electromagnetic fields from adjacent systems. Typically, when three or more such EAS systems 10 are employed along a single line, the electromagnetic fields generated by every other system (i.e., first, third, fifth, etc.) are each maintained at a common first phase (i.e., "in" phase) and the electromagnetic fields generated by the systems therebetween (i.e., second, fourth, etc.) are each maintained out of phase with respect to the first phase and preferably all precisely 180° out of phase.

Figure 2A:
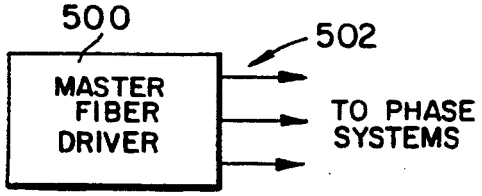
FIG. 2A is a functional block diagram of a master fiber driver which could be employed in connection with the transmitter shown in FIG. 2.
Figure 2:
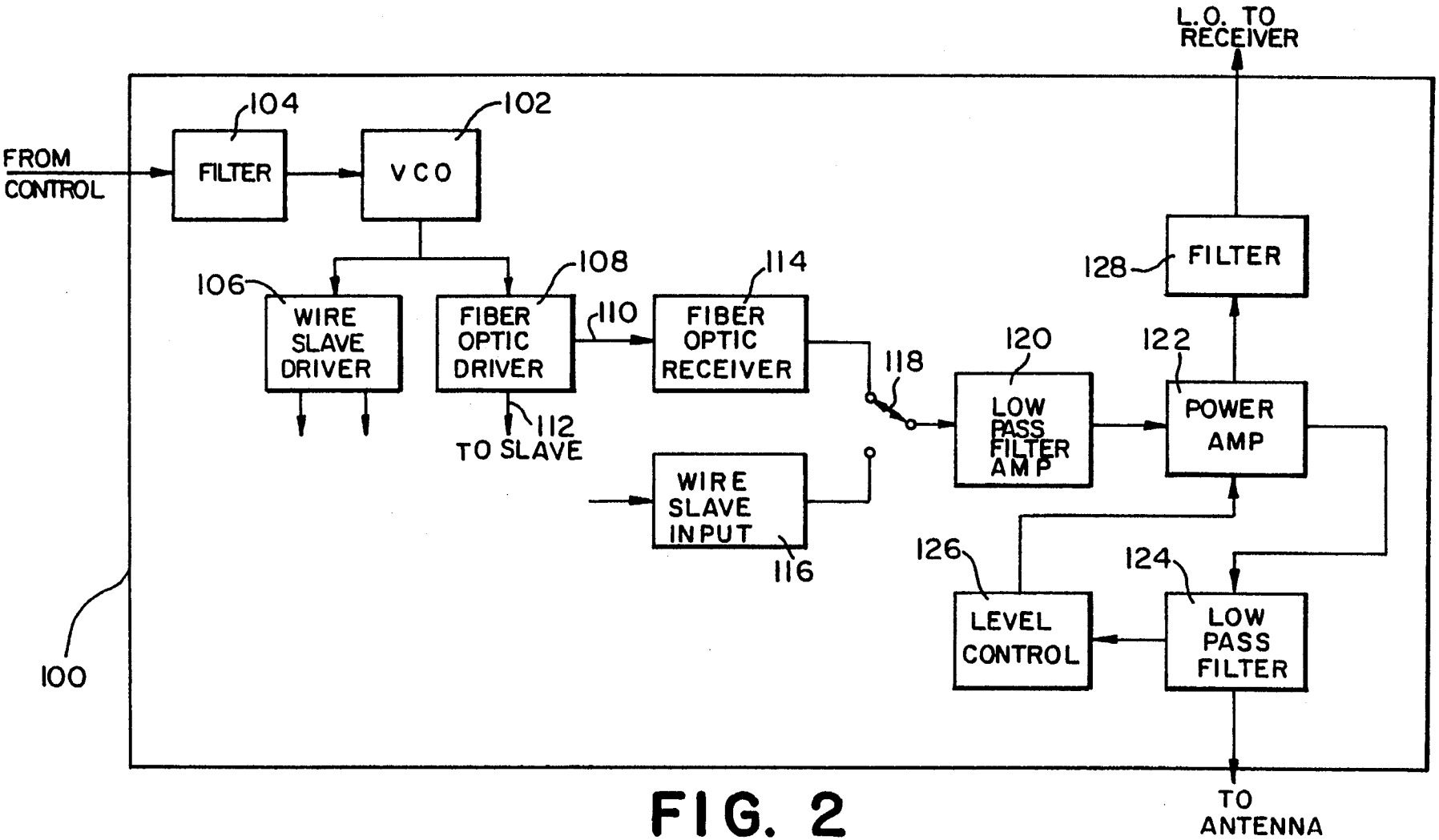
FIG. 2 is a more detailed functional block diagram schematic of the transmitter portion of the system shown in FIG. 1.

FIG. 2 is a more detailed functional block diagram of a preferred embodiment of a transmitter 100 for use in the present EAS system 10. As briefly discussed above, the transmitter 100 is employed to provide an RF output signal to the antenna assembly 150 which is swept upwardly and downwardly at a predetermined sweep rate within a predetermined frequency range generally surrounding the resonant frequency of the tags 12 employed with the EAS system 10. In the presently preferred embodiment, the output frequency is swept between a low frequency of 7.4 MHz and a high frequency of 9.0 MHz and, thus, has a bandwidth of approximately 1.6 MHz and a center frequency of 8.2 MHz. Tags 12 employed with the EAS system 10 typically have a resonant frequency of 8.2 but the resonant frequency may vary upwardly or downwardly due to a variety of factors including manufacturing tolerances, environmental conditions, etc. By sweeping through a band on both sides of 8.2 MHz, the EAS system 10 compensates for such tag variations and is able to reliably detect the presence of a high percentage of all tags 12 which are present within the detection zone. In the presently preferred embodiment, the sweep rate is 164 Hz. It will be appreciated by those skilled in the art that for a particular application a different sweep frequency range (broader or narrower), having a different center frequency, may be selected and/or that the sweep rate may vary, if desired.

Preferably, the output signal from the transmitter 100 is in the form of a generally sinusoidal shaped wave. Its frequency variations will have rounded upper and lower corners to provide a generally linear area at least within the range of about 7.6 MHz to 8.8 MHz on both the upward and downward sweeps. In the presently preferred embodiment, the power of the output signal from the transmitter 100 is approximately 4.5 watts maximum. However, it should be understood that the shape of the output waveform and the output power may vary.

The transmitter 100 includes a voltage controlled oscillator (VCO) 102 generally of a type well known in the art. In the present embodiment, the voltage controlled oscillator 102 has a center frequency of 8.2 MHz and a maximum sweep range of between about 6.5 MHz and 9.9 MHz. The center frequency and deviation of the voltage controlled oscillator may be varied, if desired.

The voltage controlled oscillator 102 is controlled by a 164 Hz square wave control signal provided by a controller (not shown in FIG. 2) included within the data processing and control section 300. The control signal is applied to a filter system 104 which includes a suitable buffer, integrator and filter components and networks of a type well known to those skilled in the art to provide a sinusoidal output signal to the voltage controlled oscillator 102 at a frequency of 164 Hz. The frequency of the control signal and thus output signal to the voltage controlled oscillator 102 may be varied, if desired, order to change the sweep rate of the voltage controlled oscillator 102.

The swept output signal from the voltage controlled oscillator 102 is applied to a driver means in the present embodiment a wire slave driver 106 and a fiber optic driver 108. The wire slave driver 106 may be used for employment of the present EAS system 10 in a master/-slave relationship with different types of EAS systems which are interconnected via a transmission path such as a wire or cable (not shown). The fiber optic driver 108 is employed when the present EAS system 10 is operated in the first mode (single system) or in the second mode (two systems in master/slave arrangement). The fiber optic driver 108 receives the swept output signal from the voltage controlled oscillator 102, amplifies the output signal, and provides two identical signals which are precisely in phase. Each of the resulting signals are then suitably modulated in a manner well known in the art for transmission along a transmission path which in the present embodiment is comprised of separate fiber optic cables 110 and 112. Both of the fiber optic cables 110 and 112 are exactly the same length so that the modulated signals at the distal ends of each of the cables 110 and 112 continue to be maintained with the same precise phase relationship. Fiber optic cables 110, 112 are of a type well known to those skilled in the art. Further details of the structure and operation of the fiber optic driver 108 and the fiber optic cables 110, 112 are not necessary for a full understanding of the present invention and are not presented herein.

The transmitter 100 further comprises transmission path receiver means, in the present embodiment a fiber optic receiver 114 which is also of a type well known to those skilled in the art. The fiber optic receiver 114 receives and demodulates signals from a fiber optic cable connected to its input port (not shown). The fiber optic cable connected to the input port of the fiber optic receiver 114 depends upon the particular mode of operation of the EAS system 10. If the EAS system 10 is operating in the first mode (single system), then either fiber optic cable 110, 112 from the fiber optic driver 108 is connected to the input port of the fiber optic receiver 114 and the other fiber optic cable 110, 112 is not used. If the EAS system 10 is operating in the second mode (two systems in master/slave arrangement), then one of the fiber optic cables 110, 112 is connected to the input port of the fiber optic receiver 114 of the master system and the other fiber optic cable 110, 112 from the master system is connected to the input port of the fiber optic receiver 114 of the second or slave EAS system (not shown). In this manner, the master system transmitter operates with the one signal from the master system VCO and the slave system transmitter operates with the other signal from the VCO of the same master system.

If the EAS system 10 is being operated as one system in the third mode (more than two systems), then the input to the fiber optic receiver 114 is supplied by a master fiber driver 500 as shown in FIG. 2A. The master fiber driver 500 combines the functional aspects of the controller, filter 104, voltage controlled oscillator 102, and fiber optic driver 108 in a single, independent multiple output unit. More specifically, the master fiber driver 500 functions to provide modulated swept frequency synchronous output signals to a plurality of in-phase fiber optic cables 502. All of the fiber optic output cables 502 from the master fiber driver 500 are precisely the same length so that the precise phase relationship between all of the output signals is maintained at the distal ends of the cables 502. One of the fiber optic cables 502 is connected to each of the input ports of the fiber optic receivers 114 of every EAS system being employed, The transmitter 100 further comprises transmission path receiver means in the form of a wire slave input device 116 for receiving an oscillator output signal from another system (not shown) of a different type over a cable or wire to permit the EAS system 10 to function as a slave unit with another system which does not use fiber optical communication means. Alternatively, a wire cable (not shown) could interconnect the wire slave driver 106 to the wire slave input 116 of a single system operating in the first mode. The outputs of the wire slave input device 116 and the fiber optic receiver 114 are each connected to inputs of a selector means, in the present embodiment a selector switch 118 which, as shown in FIG. 2, is switched to the fiber optic receiver 114 whenever another, different type of master system is not employed.

For the sake of brevity, the remainder of the description of the EAS system 10 will be limited to a system operating in the first mode as illustrated in FIG. 2. It should be understood that the EAS system 10 is not limited to single unit operation and that one skilled in the art can understand from the following description how the present system 10 functions in a master/slave configuration.

The demodulated swept frequency signal from the fiber optic receiver 114 is applied through the switch 118 to an amplifier means comprised of suitable filters and amplifiers including a low pass filter and amplifier 120 where the signal is amplified and low pass filtered to remove undesirable harmonics. The low pass filter and amplifier 120 is of a type well known to those skilled in the art. The output signal from the low pass filter and amplifier 120 is applied to a multi-stage power amplifier 122 which is also of a type well known in the art. The power amplifier 122 amplifies the output signal to a desired output level, in the present embodiment, a maximum of about 4.5 watts. The output level may be varied depending upon the particular operating environment of the system 10 and depending upon other factors.

The output signal from the power amplifier 122 is applied to a separate low pass filter 124 which is also of a type well known in the art. In the present embodiment, the low pass filter 124 is a 12 MHz low pass filter although it will be apparent to those skilled in the art that the low pass filter 124 may be established to pass any other suitable range of frequencies. In this manner, remaining harmonics and other undesired signals are removed from the output signal of the transmitter 100.

The amplified filtered output signal from the low pass filter 124 is passed to the antenna assembly 150 for transmission into the detection zone. The antenna assembly 150 includes means for permitting the antenna assembly drive signal from the transmitter 100 to be configured in either of two manners, an "in phase" manner and an "out of phase" manner. The phase determines the orientation of the field established by the antenna assembly 150. In the preferred embodiment, the phase orientation is determined by the manner in which a pair of jumper cables (not shown) are connected, but this feature could be accomplished in some other manner known or apparent to those skilled in the art. When a system is operated in the first mode, either phase configuration may be employed. When operating in the second mode, a master system operates in one phase and a slave system operates in the other phase. When operating in the third mode, every other system (i.e., first, third, etc.) operates in one phase ("in phase") and the alternate systems (i.e., second, fourth, etc.) operate in the other phase ("out of phase"). A suitable impedance matching network of a type well known in the art may be employed for coupling the output signal from the low pass filter 124 to the antenna assembly 150.

A power level control, in the present embodiment an automatic power level control 126, also receives the output signal from the low pass filter 124. The automatic power level control 126 compares the amplitude of the output signal from the low pass filter 124 to a predetermined reference level established by the system user and generates an output control signal which is applied to the power amplifier 122 to adjust the amplification of the power amplifier 122 to provide an output signal having an amplitude corresponding to the predetermined reference level. The automatic power level control 126 is of a type well known in the art. As previously stated, the output power level from the transmitter 100 is controllable by the system user and will vary from system to system depending upon environmental and other factors.

The output of an intermediate stage of the power amplifier 122 is obtained and is applied to a filter device 128 which amplifies, limits and filters the signal and adjusts the phase of the signal to mimic phase changes made to the transmitter output signal by the antenna assembly 150. The output from the filter device 128 is thus a precisely in phase swept frequency signal which is used as a local oscillator reference signal by the receiver 200 in a manner which will hereinafter be described. Preferably the output signal from the filter device 128 is transmitted to the receiver 200 along a shielded cable (not shown).

It should be understood that while the above described transmitter 100 is presently preferred, any other type of transmitter adapted to provide a suitable swept RF signal to the antenna assembly 150 at a suitable output power level may be employed if desired. Thus, the present invention is not limited to the particular transmitter 100 shown and described.

Figure 3:
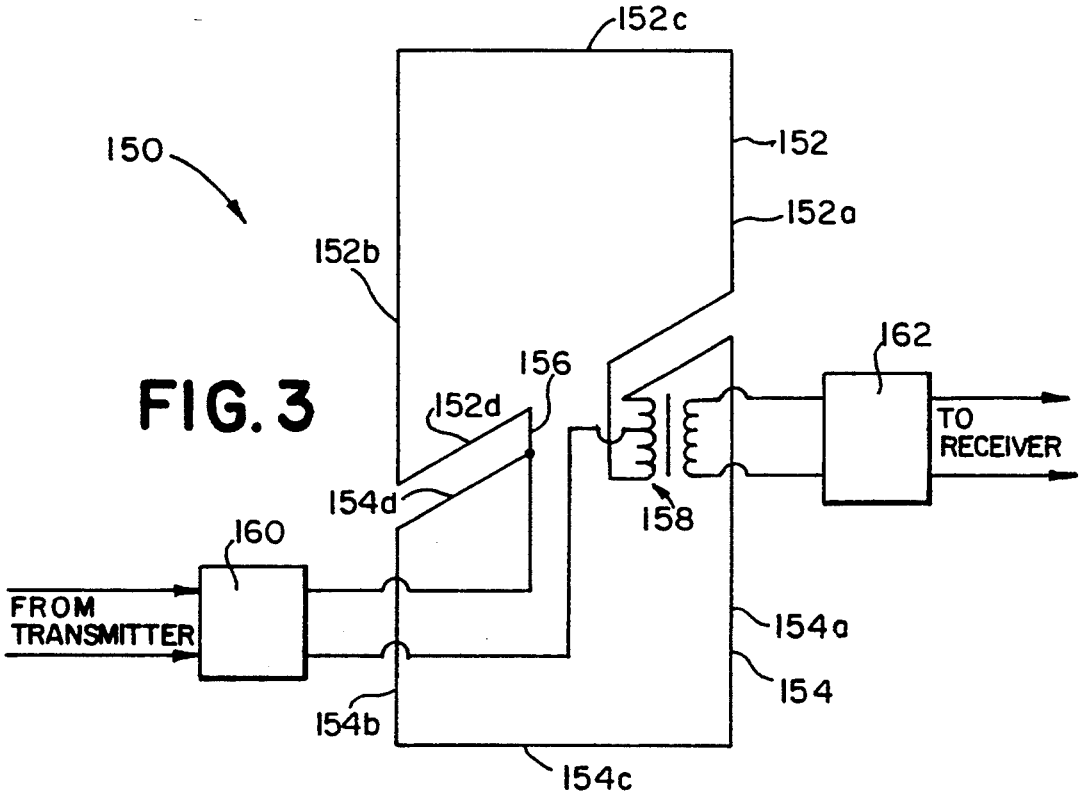
FIG. 3 is a functional schematic diagram of the antenna assembly of the system shown in FIG. 1.

FIG. 3 is a functional schematic representation of a preferred embodiment of an antenna assembly 150 in accordance with the present invention. The antenna assembly 150 which, in the present embodiment, serves as both a transmitter antenna and the receiver antenna is comprised primarily of two antenna loops 152, 154. In the present embodiment, the two loops 152, 154 are generally co-planar with one loop 152 above the other loop 154 so that loop 152 forms the upper or top loop and loop 154 forms the lower or bottom loop. However, it will be appreciated by those skilled in the art that the loops 152, 154 may be arranged in some other, preferably co-planar orientation, such as side by side, without departing from the scope of the present invention. It will also be appreciated that while the antenna assembly 150 serves as both a transmitter antenna and a receiver antenna, these two functions may be provided by separate, physically separated transmit and receive antenna assemblies if desired.

In the present embodiment, each of the antenna loops 152, 154 is generally in the shape of a quadrilateral containing a pair of generally parallel, generally vertically extending sides 152*a*, 152*b* and 154*a*, 154*b*, a third, generally horizontal side 152*c*, 154*c* generally perpendicular to and interconnecting the two parallel sides, and a fourth side 152*d*, 154*d* which extends between the two parallel sides at an angle which is other than 90°. The angle of side 152*d* of the top loop 152 generally complements the angle of side 154*d* of the bottom loop 154 so the angled sides 152*d*, 154*d* are generally parallel to each other and spaced slightly apart. In the presently preferred embodiment, the angles formed between the angled sides 152*d*, 154*d*, and sides 152*b* and 154*a*, are approximately 60° but any other suitable angles could be alternatively employed.

The overall size or enclosed area of each of the loops 152, 154 is substantially the same, however, the loops are complementary shaped so that when the loops are oriented as shown with loop 152 on the top and loop 154 on the bottom, and with the angled sides 152*d*, 154*d* of the loops adjacent each other, the overall shape of the combined loops forming the antenna assembly 150 is generally rectangular. It will be appreciated by those skilled in the art that other loop or antenna assembly geometries may be employed in the alternative.

As previously stated, the overall size of the loops is substantially the same. That is, the area contained within or encompassed by each of the loops 152 and 154 is substantially the same and the overall perimeter of each of the loops 152, 154 is substantially the same. In this manner, substantially equal current may flow in each loop such that the fields radiated from each of the loops are generally equal in magnitude to each other. The size of each of the loops 152, 154 is substantially less than the wavelength of the RF energy to be transmitted and received.

Preferably, each of the loops 152, 154 is comprised of a single length of a conductor or multi-strand wire of a type well known to those in the electronic article surveillance art. However, it will be appreciated by those skilled in the art that other conducting elements, including single strand wire, may be used, if desired, without departing from the scope of the present invention.

One end of loop 152 is joined to one end of loop 154 by a conductor 156 extending along the angled sides 152*d*, 154*d*. The other ends of each of the loops 152, 154 are connected to opposite ends of the primary winding of a center tapped transformer 158.

The antenna as thus far described simultaneously functions both as a transmitting antenna and as a receiving antenna for the EAS system 10. The amplified RF output signal from the transmitter 100 is applied to the antenna assembly 150 through a suitable impedance matching network 160. In the presently preferred embodiment, the matching network 160 comprised of a pair of resistors (not shown), a pair of capacitors (not shown), and a pair of tunable inductors (not shown), so that when electrically combined with the inductive impedance inherent in the antenna loops 152, 154, an overall net resistive impedance is presented to the transmitter 100. However, it will be appreciated by those skilled in the art that other suitable matching networks may be used in the alternative.

The output of the matching network 160 is connected to one end of each of the antenna loops 152, 154 at conductor 156 and to the other end of each of the antenna loops 152, 154 through the center tap of the primary winding of transformer 158. In this manner, the output signal current from the transmitter 100, after passing through the matching circuit 160, flows through the antenna loops 152, 154 in opposite directions. For example, if the output signal from the transmitter flows through antenna loop 152 in a clockwise direction, the transmitter output signal flows through antenna loop 154 in a counterclockwise direction. Since the two antenna loops 152, 154 are generally equal in size, the current flowing through each of the antenna loops 152, 154 is generally equal in magnitude but in opposite directions. Thus, the fields radiated by the antenna loops 152, 154 are generally equal in magnitude but extend in opposite directions or are 180° out of phase. In this manner the antenna assembly 150 effectively achieves substantial cancellation of the radiated fields when measured in the far field, multiple wavelengths from the antenna assembly 150.

In addition to functioning as a transmitting antenna, the antenna assembly 150 simultaneously functions as the receiving antenna for the EAS system 10. The secondary winding of transformer 158 is connected to a suitable matching circuit 162, the output of which is connected to the input of the receiver 200. In the presently preferred embodiment, the matching circuit 162 is comprised of a single capacitor (not shown) but some other matching circuit could be employed if desired.

The transformer 158 is configured so that when the currents flowing through the two antenna loops 152, 154 are equal (i.e., the transmitter signals are present in the antenna loops 152, 154 and no tag 12 or other object is present to create a detectable disturbance in the fields generated by the antenna loops 152, 154), the net magnetic flux generated by the current passing through the primary windings of transformer 158 is zero and there is no signal applied to the receiver. Thus, the voltage on the secondary winding of the transformer 158 is also zero. Any difference in the currents passing through the primary windings of the transformer 158 which is caused by an externally generated field, such as the presence of a tag 12 in the vicinity of the antenna assembly 150, generates magnetic flux which causes a voltage to be generated on the secondary winding of the transformer 158 in proportion to the difference between the currents flowing in the two antenna loops 152, 154 and thus through the primary windings of the transformer 158. In this manner, the antenna assembly 150 is insensitive to the electromagnetic fields that are radiated by it but is very sensitive to fields radiated by external sources such as a tag 12. It will be appreciated by those skilled in the art that the function of sensing the difference between the currents in the two loops 152, 154 can be performed in some other manner, if desired. For example, a directional coupler could be used or a bridge circuit could be configured with the two antenna loops 152, 154 comprising two elements of the bridge.

The purpose of the angled sides 152*d*, 154*d* of the antenna loops 152, 154 is to reduce the magnitude of the cancellation of the fields generated by individual elements of the antenna assembly 150 near the vertical center of the antenna assembly 150. With prior art antennas, the crossover elements between the parallel side elements of the antenna were substantially parallel to the top and bottom sides of the antenna loops and thus the magnitude of the resulting field near the center of the antenna was diminished. An additional advantage of having angled loop sides 152*d*, 154*d* is that the area of reduced antenna field proximate the crossover elements is not in a horizontal plane across the entire width of the antenna assembly 150 but follows the generally angled plane of the angled loop sides 152*d*, 154*d*, thereby making it more difficult for a protected article with a tag 12 attached to pass through the detection zone in a fixed orientation without being detected.

Figure 4:
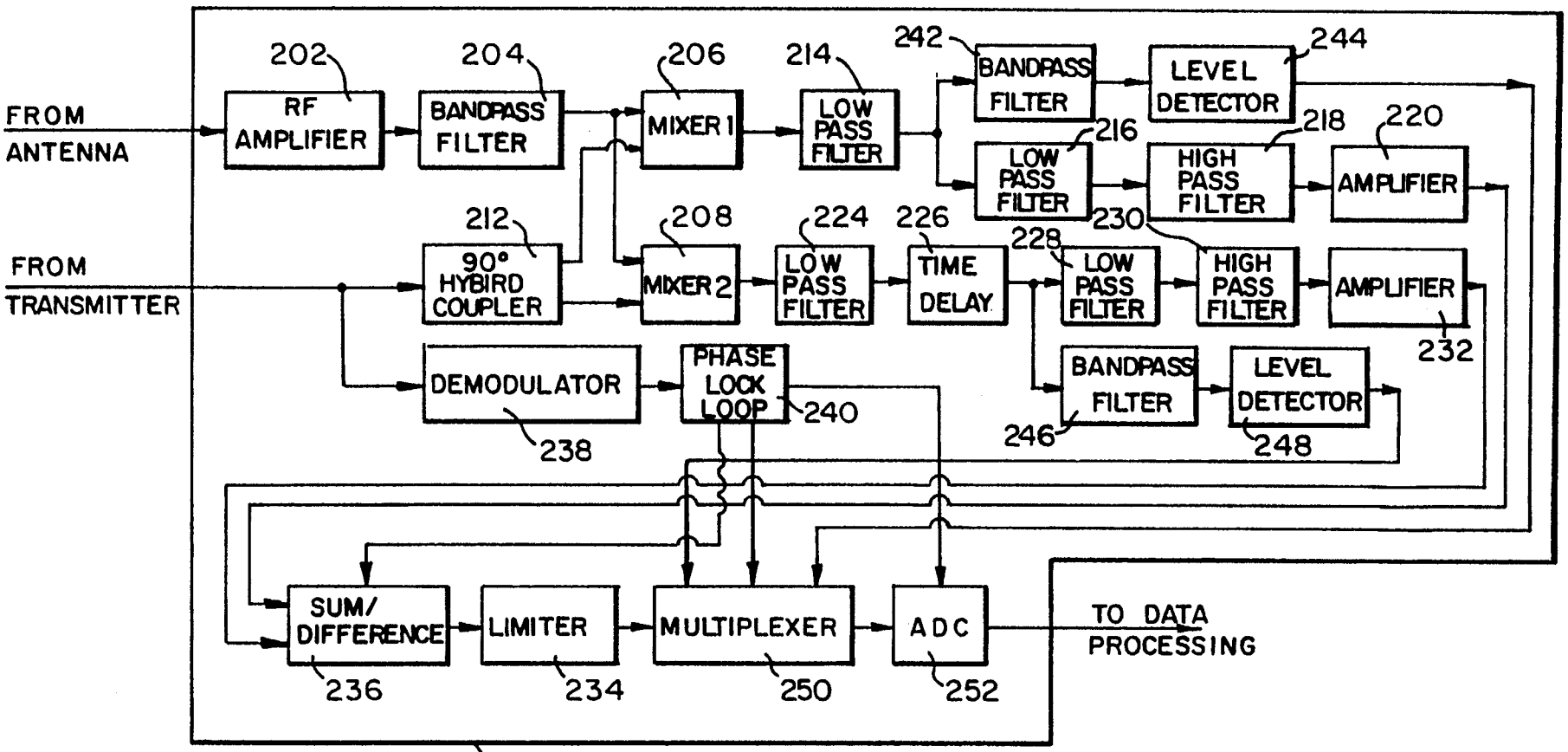
FIG. 4 is a more detailed functional block diagram schematic of the receiver portion of the system shown in FIG. 1.

A preferred embodiment of the receiver 200 is shown in FIG. 4. The receiver receives RF signals from the antenna system 150 through a suitable impedance matching network (not shown on FIG. 4) as described above. The antenna system output signals are initially fed to a low noise RF amplifier or pre-amp 202 which boosts the received antenna signals to a level which is high enough to facilitate further signal processing. The RF amplifier 202 is generally of a type well known in the art and preferably provides a gain of about 15 dB or more.

The output signal from the RF amplifier 202 is fed to a bandpass filter 204 which is also of a type generally well known to those skilled in the art. In the present embodiment, the bandpass filter 204 has a center frequency of 8.2 MHz and preferably passes signals in the range of from 6.5 MHz to 10.0 MHz. In the presently preferred embodiment, the bandpass filter 204 is of the passive, double tuned type but it will be appreciated by those skilled in the art that any other suitable type of bandpass filter may alternatively be employed.

The present embodiment employs an image reject mixer scheme to improve signal to noise ratio and thus enhance detection. The output signal from the bandpass filter 204 is concurrently applied via a 6 dB in phase splitter (not shown) to a first input of each of a pair of balanced mixers 206 and 208. Each of the mixers 206 and 208 also receives a separate local oscillator signal at a second input. The local oscillator signal is obtained by receiving a local oscillator reference signal from the transmitter 100 via a shielded coaxial cable (not shown). The local oscillator reference signal is first applied to a 90° hybrid coupler 212 having two outputs which are phase shifted from each other by 90°. The first output of the 90° hybrid coupler 212 is applied to the second input of the first mixer 206 and the second output of the 90° hybrid coupler 212 is applied to the second input of the second mixer 208. In this manner, the second inputs of the mixers 206 and 208 have an effective phase difference of 90°. The 90° hybrid coupler 212 is of a type well known in the receiver art.

The amplified filter signal from the antenna system 150 is mixed with the local oscillator signals from the transmitter 100 in the two mixers 206 and 208 at a phase shift of 90°. Mixing the signals in this manner permits the rejection of image noise that is present on both the upsweep and the downsweep of the transmitter 200. During the upsweep, image noise above the local oscillator frequency is rejected and during the downsweep, image noise below the local oscillator frequency is rejected. The mixing thus results in a pair of low noise mixer output signals which are 90° out of phase with one output signal leading or lagging the other depending on whether the RF input signal is above or below the local oscillator frequency. The output signals from mixers 206 and 208 are thereafter processed by separate but generally parallel networks in a manner which will hereinafter be described.

The detected output signal from the first mixer 206 is applied to a low pass filter 214 which effectively filters out high frequency noise. In the present embodiment, the low pass filter 214 filters out all portions of the signal which are at a frequency greater than 30 KHz. The output signal from the low pass filter is applied to another low pass filter 216. In the present embodiment, low pass filter 216 is preferably of the four pole Butterworth type and effectively passes all signals at a frequency less than 10 KHz.

The output signal from the low pass filter 216 is applied to a high pass filter 218. In the presently preferred embodiment, high pass filter 218 is also preferably of the six pole Butterworth type and is tuned to pass signals having a frequency above 2 KHz. The output signal from high pass filter 218 is amplified by an amplifier 220 to increase the amplitude range of the signal.

Concurrently, the detected output of the second mixer 208 is applied to a low pass filter 224 which is substantially identical to low pass filter 214. The output of low pass filter 224 is then applied to a time delay circuit 226 which effectively delays the signal by 90° from the other channel. At this point, the channels are effectively 180° apart, achieving signals that are in phase in one direction of the sweep and are out of phase in the other direction of the sweep. The output signal from the time delay circuit 226 is applied to a low pass filter 228 which is substantially the same as low pass filter 216. The output from the low pass filter 228 is applied to a high pass filter 230 which is substantially the same as high pass filter 218. The output from high pass filter 230 is applied to an amplifier 232 which is the same as amplifier 220. In this manner, the output signals from each of the amplifiers 220, 232 are representative of separately processed but generally parallel receiver channels with a 180° phase difference.

Both of the outputs from the amplifier 220, 232 are applied to a sum/difference circuit 236. The sum/difference circuit 236 functions in accordance with the sweep direction from the local oscillator reference signal to take the sum of the two detected input signals from the two channels during the upsweep portion of the transmitter sweep (i.e., from 7.4 MHz to 9.0 MHz) when the desired tag information is below the local oscillator frequency and to take the difference between the two input signals from the two channels during the downsweep portion of the transmitter sweep (i.e., from 9.0 MHz to 7.4 MHz) when the desired tag information is above the local oscillator frequency. The output from the sum/difference is sampled and held constant for analog to digital conversion by a limiter 234 which also limits the output to a predetermined maximum signal level, in the present embodiment 6 volts peak to peak.

The local oscillator reference signal from the transmitter 100 is also applied to a demodulator 238 which detects or demodulates the local oscillator reference signal to recover the 164 Hz control signal. The recovered 164 Hz signal is shifted 90° and converted to a square wave which is fed to a phase lock loop circuit 240. The feedback loop of the phase lock loop circuit 240 contains a divide by 9,216 that allows the feedback loop to lock at a frequency of 1,511,424 Hz which is used as a sampling and converting clock for an analog to digital converter 252 (hereinafter described). The phase-locked output signal from the phase lock loop circuit 240 is also applied to the sum/difference circuit 236 to permit the sum/difference circuit to know when the transmitter is sweeping upwardly and sweeping downwardly and to a multiplexer 250 for controlling the multiplexing of two high frequency level signals described below.

The output signal from the low pass filter 214 is also fed to a 3 KHz band pass filter 242. The band pass filter 242 is of a type well known in the art and, in the present embodiment, has a center frequency of 12 KHz and passes frequencies between 10.5 and 13.5 The output from the band pass filter 242 is applied to a level detector 244 which effectively determines the average amplitude level of high frequency noise (10.5–13.5 KHz) within the filtered output signal from the first mixer 206 for a predetermined time period which, in the present embodiment, coincides with the sweep time (i.e., 1/164 sec).

Similarly, the output signal from the time delay network 226 is applied to a second 3 KHz bandpass filter 246 which is also of a type generally well known in the art. Bandpass filter 246 passes signals in the frequency range of 19–22 KHz. The output signal from bandpass filter 246 is applied to a second level detector 248 which determines the average amplitude level of the high frequency noise (19–22 KHz) in the filtered, time delayed output signal from the second mixer 208. The output signals from level detectors 244 and 248 are periodically sampled by the data processing and control system 300 for purposes which will hereinafter become apparent. The output signals from level detectors 244 and 248 are applied to separate inputs of a multiplexer 250. The multiplexer 250 also receives the output signal from the sum/difference circuit 236. The multiplexer 250, in the present embodiment, is an analog multiplexer of a type generally well known in the art. The multiplexer 250 functions under control of the signal from the phase lock loop circuit 240 to pass the signal from the limiter 234 during the linear portions of the swept transmitter sweep signal and to pass the high frequency level signals during the curved portions of the transmitter sweep signal where no tag signal is expected.

The output from the multiplexer 250 is provided to a 16 bit analog to digital converter means or converter (ADC) 252. The ADC 252, in the present embodiment, is of a type well-known in the art and commercially available from a variety of sources, including Burr-Brown of Tuscon, Ariz. The ADC 252 takes 256 time-spaced samples of the analog output signal from the multiplexer 250 coinciding with each complete sweep period of the transmitter signal from 7.4 MHz upwardly to 9.0 MHz and then downwardly to 7.4 MHz. Thus, 128 samples correspond to the upwardly sweeping portion of each transmitter sweep cycle and 128 samples correspond to the downwardly sweeping portion of each transmitter sweep cycle. Each 256 samples (1 complete transmitter sweep cycle) is defined to be and hereinafter is referred to as one frame and all of the samples from the ADC are stored and are generally manipulated (as hereinafter described) on a per frame basis. As discussed above, the transmitter is swept through the 7.4–9.0–7.4 MHz band at a preferred sweep frequency of 164 Hz. Thus, the ADC 252 provides an output of approximately 42,000 samples or digital numbers per second. The timing for the sampling is provided by the phase lock loop circuit 240 which utilizes the local oscillator reference signal from the transmitter 100 for synchronization. Thus, 256 samples will always be generated for each transmitter sweep cycle even though the number of sweep cycles per second may vary. By closely locking specific sample number to the swept transmitter signal frequencies of each sweep cycle, detection performance is enhanced. Further details of the structure and operation of the ADC are not necessary for an understanding of the present system and may be obtained from the manufacturer.

It will be appreciated by those skilled in the art that while the present embodiment employs a receiver 200, the structure and operation of which are described and shown, the present invention is not limited to the particular receiver or even the same type of receiver shown and described. Thus, any other suitable type of receiver capable of receiving and detecting, demodulating or decoding signals in the RF frequency range employed by the particular system could be employed in the alternative. In addition, if desired, the analog to digital conversion of the receiver could be performed separately from the receiver function.

Figure 5:
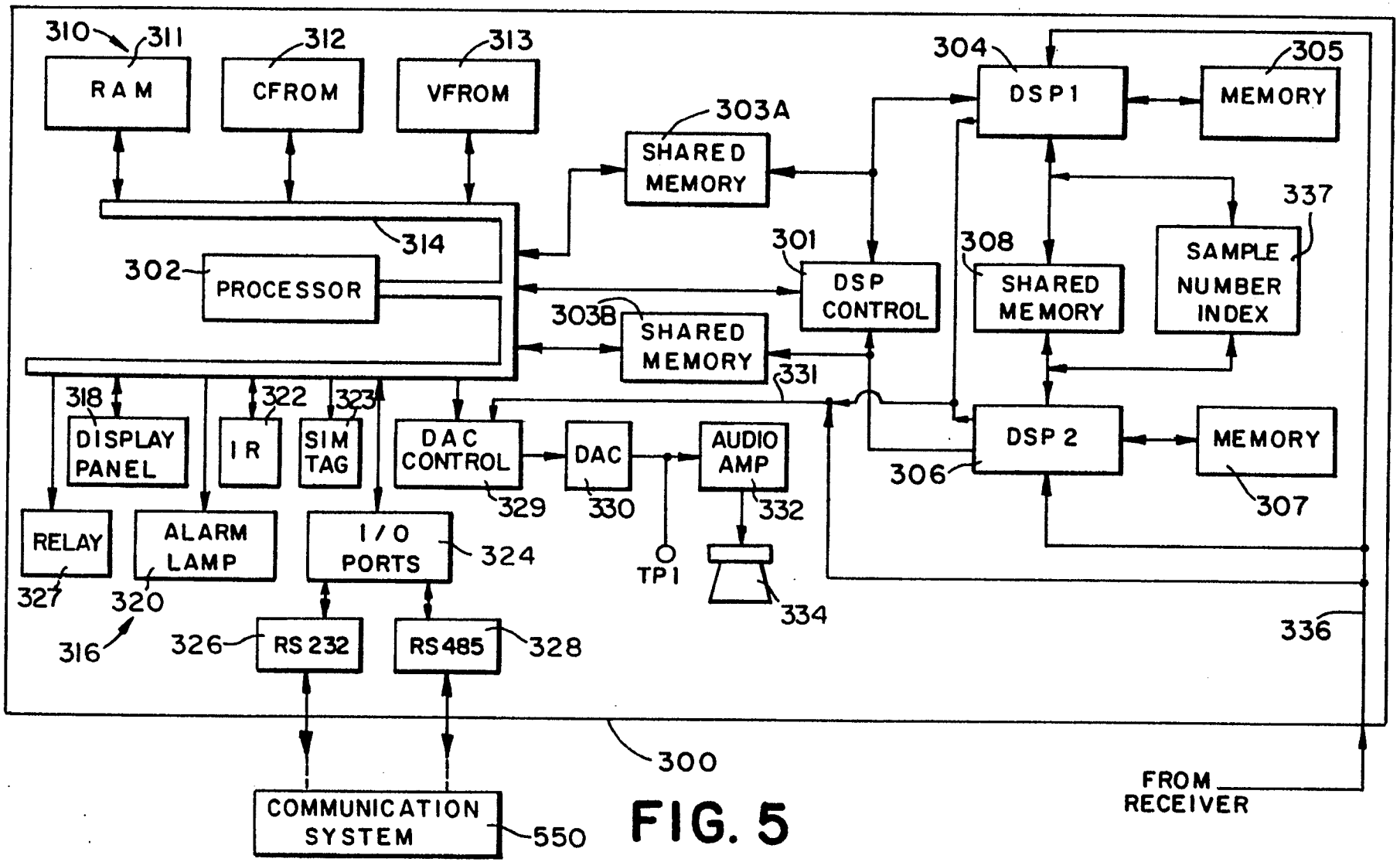
FIG. 5 is a more detailed functional block diagram schematic of the data processing and control portion of the system shown in FIG. 1.

The frames of output samples from the ADC 252 are provided to the data processing and control section or system 300. FIG. 5 is a schematic block diagram representation of a preferred embodiment of the hardware portion of the data processing and control system 300. The heart of the data processing and control system 300 of the illustrated embodiment is a combination of a multi-tasking processor or processor 302, in the presently preferred embodiment an 80186 microprocessor commercially available from INTEL and a pair of digital signal processors 304 and 306 hereinafter respectively referred as "DSP1 and DSP2". In the presently preferred embodiment, each of the digital signal processors DSP1 and DSP2 is a TMS320C25 processor chip available from Texas Instruments and both are under the control of the processor 302. It will be appreciated by those skilled in the art that while a specific microprocessor and specific digital signal processor chips are presently preferred that the invention is not limited to the particular microprocessor and/or digital signal processor chips disclosed but, alternatively, could be implemented either separately or together using any other suitable microprocessor and/or processor chips or any other type of processor. In addition, portions of the processing could be accomplished utilizing discrete digital or analog circuitry if desired.

The DSP1 and DSP2 chips share memory, in the present embodiment a 2K×16 bit shared random access memory 308. The shared memory 308 may be used to pass data between the two DSP chips, and more specifically, to pass processed output data from DSP1 to DSP2 for further processing in a manner which will hereinafter be described. Preferably, a stored message/interrupt procedure of a type well known in the art is used to pass the data. The DSP1 and DSP2 chips each also have their own program and data space memories 305 and 307 which may be internal to the chip or may be a separate, random access memory, in the present embodiment 32K×16 bits. The memories 305 and 307 are used by DSP1 and DSP2 for storing data and operating instructions. The DSP1 and DSP2 chips each share additional memory with the multi-tasking processor 302, in the present embodiment 2K×16 bit shared random access memories 303A and 303B. The shared memories 303A and 303B are used for passing data and instructions between the multi-tasking processor 302 and the DSP1 and DSP2 chips using a message store/interrupt procedure of a type well known in the art. The multi-tasking processor 302 may also communicate directly with DSP1 or DSP2 through a DSP controller 301 which, in the present embodiment, is comprised of conventional discrete logic circuitry. Alternatively, the multi-tasking processor 302 may directly communicate with DSP1 or DSP2 along a suitable bus line (not shown).

The multi-tasking processor 302 has its own memory, shown generally as 310, which is employed for storing the software and data necessary for system initiation, testing, operation and upgrading. In the present embodiment, the multi-tasking processor memory 310 includes a combination of random access memory (RAM) 311, code flash read only memory (CFROM) 312, and voice flash read only memory (VFROM) 313. More specifically, the RAM 311 is comprised of the combination of a high-speed workspace memory formed by a 256K×16 bit dynamic random access memory (DRAM) (not shown) and an 8K×8 bit non-volatile, battery-backed RAM with a clock (BRAM) (not shown). The CFROM 312 is comprised of a programmable 128K×16 bit code flash ROM to permit remote updating, upgrading, fine tuning or other adjustments or changes to the system software, parameters and data through input/output means as hereinafter described. The VFROM 313 comprises a 128K×16 bit voice flash ROM for storing data to facilitate audio outputs as well as codes as will hereinafter be described. It will be appreciated by those skilled in the art that the multi-tasking processor memory 310 may be implemented in some other manner using differing types or combinations of memory devices or even a single memory device if desired without departing from the present invention and that the various memory devices may be used for other purposes if desired.

Each of the multi-tasking processor memory devices 310 are connected to the multi-tasking processor 302 by a common bus 314 in a manner well known to those skilled in the art. Other usable memory/processor architecture will also be apparent to those skilled in the art. The shared memories 303A and 303B and the DSP controller 301, in the present embodiment, also communicate with the multi-tasking processor 302 utilizing the common bus 314, although they may communicate using a separate bus (not shown) or in some other manner which would be apparent to those skilled in the art.

The data processing and control system 300 also includes a plurality of input/output devices shown generally as 316. In the presently preferred embodiment, the input/output devices 316 include a display panel 318 having a liquid crystal display (not shown) and a series of input switches (not shown) for use with menu driven software for controlling or changing the operation of the data processing and control system 300. An alarm lamp 320 (in the present embodiment a pair of alarm lamps) is provided to be illuminated in the presence of an alarm condition (hereinafter described). IR beam circuitry 322 is provided to produce and detect infrared beams of light within the detection zone to permit detection of the presence of a person or object within the detection zone, as well as to provide a communication channel between neighboring EAS systems. A tuned circuit simulating a tag 323 which can be turned on or off by the processor 302 is provided for self or auto-tuning of the data processing circuitry. A pair of serial input/output ports 324 are provided for external communications. An RS232 port 326 is provided to permit servicing and diagnostic testing and communication from a remote location via a suitable cable/connector arrangement (not shown) for obtaining data from or providing data or instructions to the data processing and control system 300. An RS485 port 328 is provided to permit communication between the data processing and control system 300 and the data processing and control system of other EAS units or systems (not shown) which may be operating in the vicinity, either in the second or third mode of operation. The RS 485 port 238 may also be used for servicing and diagnostic testing through a suitable interface adapter. A pair of relays 327 are provided for external remote alarm signaling use (hereinafter described).

The input/output devices 316 further include a digital to analog converter means or converter (DAC) 330 which receives digital signals from the multi-tasking processor 302 via a digital to analog converter controller 329 and converts the digital signals to analog signals. The DAC controller 329 is also connected directly to DSP1 and DSP2 along a separate bus 331 to facilitate direct servicing and diagnostic testing of DSP1 and DSP2 One set of received digital signals which are converted to analog signals are voice or tone signals which are, in turn provided to a processor controlled audio amplifier 332 and thereafter, to an audio speaker 334. The DAC 330 also receives control, diagnostic and data signals which are converted to analog signals and made available to a user or service person at an analog test point adapter TP1 to which suitable test equipment (not shown) may be attached for monitoring, testing or other signal analysis.

All of the input/output devices 316 are of a conventional type well known to those skilled in the art and commercially available in a variety of styles and forms from multiple manufacturers. While the present embodiment employs the specific input/output devices 316 as described above, it will be appreciated by those skilled in the art that additional devices may also be employed or that different devices or different combinations of devices may be employed. In addition, extra or spare input/output ports (not shown) may be provided to permit communication between the data processing and control system 300 and other devices or components (not shown), if desired. Preferably, some of the input/output devices are conveniently located at a common control panel area (hereinafter described) in the base of the unit and are all in communication with the multi-tasking processor 302 via bus 314.

A primary purpose of the digital signal processing conducted by the data processing and control system 300 is to maximize the use of available signal data from the receiver 200 in order to consistently accurately determine the presence of a tag signal within the interrogation or detection zone of the EAS system 10 only when a tag 12 is actually present. The digital signal processors, DSP1 and DSP2, are employed for filtering the digitized receiver signal data to reduce noise in the digitized receiver output signal, to provide clean, relatively high strength, low noise digital signals for pattern recognition analysis to provide a high probability of tag detection and a corresponding low probability of false positives (a tag indication when no tag is present).

Two primary types of noise experienced by EAS systems are: (1) correlated or environmental noise, generally of relative long duration (5 seconds or longer) and repetitive (non random) and (2) uncorrelated or transient noise, generally of short duration (usually less than 0.2 second) and random. The present system, specifically DSP1, functions to reduce or eliminate both correlated and uncorrelated noise while detecting resonances indicative of the presence of a tag 12 within the detection zone of the EAS system 10 with a high degree of accuracy and repeatability.

Figure 6:
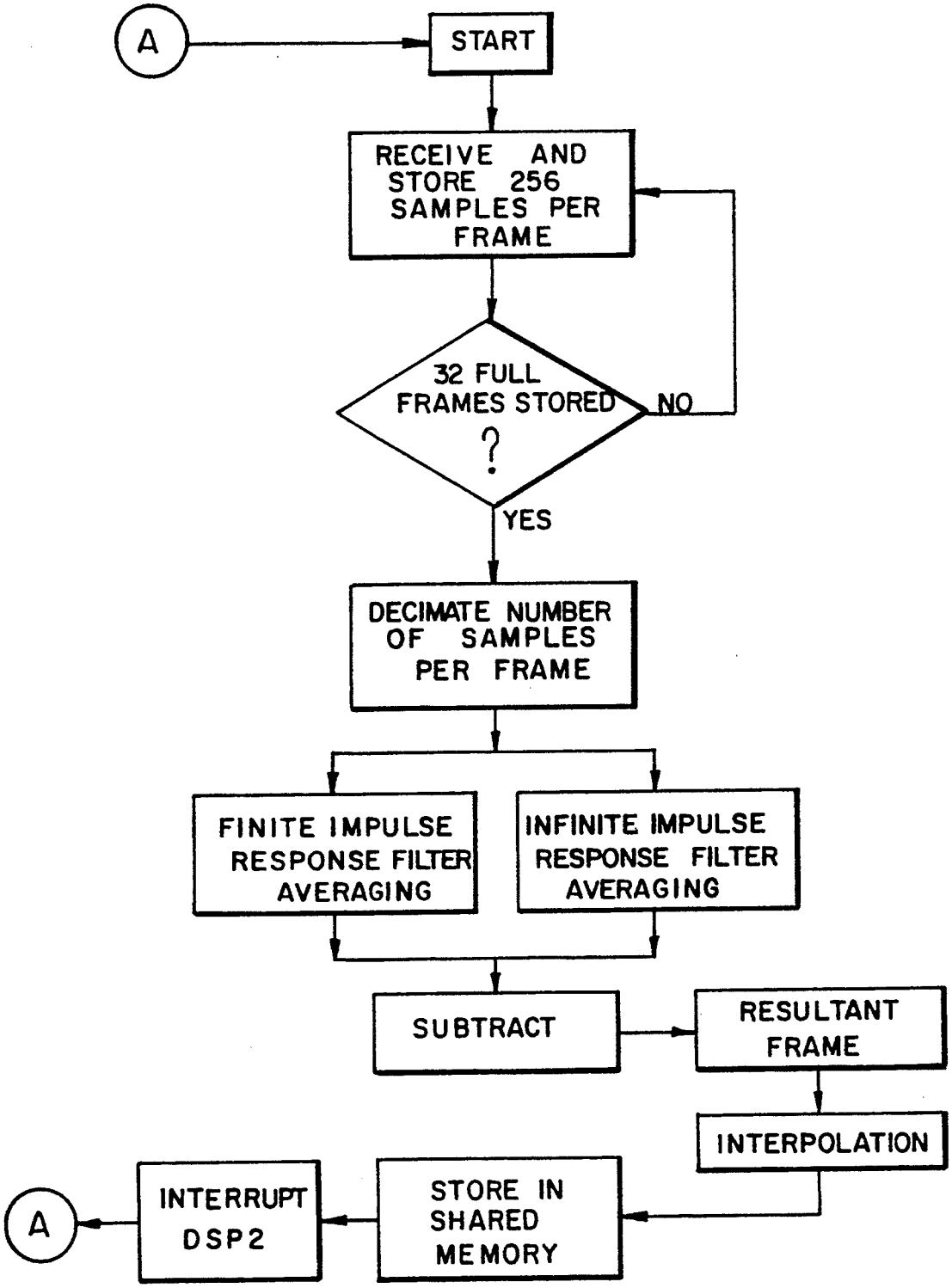
FIG. 6 is a flow diagram illustrating the functional operation of a portion of the data processing and control system of FIG. 5.

FIG. 6 is a flow diagram illustrating the functional steps implemented by DSP1. The first step in the digital filtering is performed by DSP1 which receives and temporarily stores in memory 305 each of the full frames of digital data (256 samples per frame) from the ADC along line 336. A sample number indexer 337 provides a synchronized sample number to DSP1 and DSP2 concurrently with related digitized data obtained from the receiver 200. The digitized signal from the receiver 200 is also provided to the DAC controller 329 so that the basic or raw data from the receiver can be obtained for analysis through TP1. The frames are decimated by two in DSP1 software which effectively reduces the number of samples in each frame by removing or eliminating every other sample (i.e., permitting only 128 samples per frame to remain). Reducing the number of samples per frame permits faster noise filtering without significant loss of signal information. The number of samples per frame could be reduced by some other factor or scheme if desired. For example, neighboring samples could be averaged over any selected number of samples.

DSP1 then implements a first filter, in the present embodiment a quick response or, in the preferred embodiment, finite impulse response filter to minimize random or transient noise by averaging on a one to one basis the amplitude of each of the 128 remaining samples of each frame with each of the corresponding samples within a predetermined number of prior, preferably immediately preceding, frames which are stored in memory 305. In the present embodiment, the quick response filter averages each of the 128 remaining samples of the current frame with each of the corresponding samples of the most recent 31 prior frames to provide a constant 32 frame moving sample average which effectively removes uncorrelated or short duration random noise and provides an increase in the signal to noise ratio of about 15 dB. The 15 dB increase results from the fact that the signal strength is fully additive when the samples of the 32 frames are combined but the noise is only additive by a factor of the square root of the number of frames averaged. Thus, if two frames were added, the signal strength is doubled while the noise is increased only by 1,414 to provide a 3 dB gain. It will be appreciated by those skilled in the art that the 32 frame average is arbitrary selected and some other lesser or greater number of frames could alternatively be averaged without departing from the scope and spirit of the invention. In addition, while in the present embodiment, the finite impulse response filter is applied to 128 samples of each frame, a greater number of samples (i.e., 256) or a lesser number of samples (i.e., 64, 32, etc.) could be used if desired.

At the same time, DSP1 applies a second filter, in the present embodiment an auto regressive or infinite impulse response filter to the same 128 remaining samples of each frame to eliminate correlated noise. Essentially, the auto regressive filter averages the amplitude of the 128 samples on a one to one basis over a greater number of frames or over a greater period of time than the first filter to deemphasize frame signal data and to identify more constant background or environmental noise. In the presently preferred embodiment, the quick response filter averages over approximately 0.2 seconds and the auto regressive filter averages over an infinite number of preceding frames so that the weight of each preceding frame is continuously lowered until the contribution of a single frame is negligible over time. Thus, with the auto regressive filter, no single frame provides a significant contribution to the result so the output is essentially the more constant output produced under current environmental (correlated) or background noise conditions. Of course it will be appreciated that the time duration or number of frames utilized in the auto regressive filter and the number of samples per frame to which the auto regressive filter is applied may vary without departing from the scope of the present invention.

DSP1 then takes the output of the auto regressive filter (background) and, utilizing a software subtraction means, subtracts it from the output of the quick response filter to effectively remove the background or environmental noise signals and provide resultant frame signal with a greatly enhanced signal to noise ratio at a total gain of between 15 to 40 dB depending upon the extent of environmental noise present. Thus, short duration, random noise signals environmental signals, may be removed or minimized whereas longer duration non-random signals, such as those generated by a tag are further emphasized in the resultant frame signal.

The resultant frame signal is interpolated to effectively regenerate each of the eliminated 128 samples as an average of the two samples on each side. The resultant frame is thus expanded to contain a full 256 samples. The expanded resultant frame is stored shared memory 308 for further processing by DSP2. DSP1 interrupts DSP2 to signal availability of a new frame of filtered, processed data and then returns for processing the next frame of data. It should be noted that the desired filter functions could be performed in some other manner, such as on a sample by sample basis, or could be performed utilizing discrete, electrical components, such as analog or digital components. If desired, resultant frame signals may be passed through additional filters which could enhance the signal to noise ratio.

Figure 7:
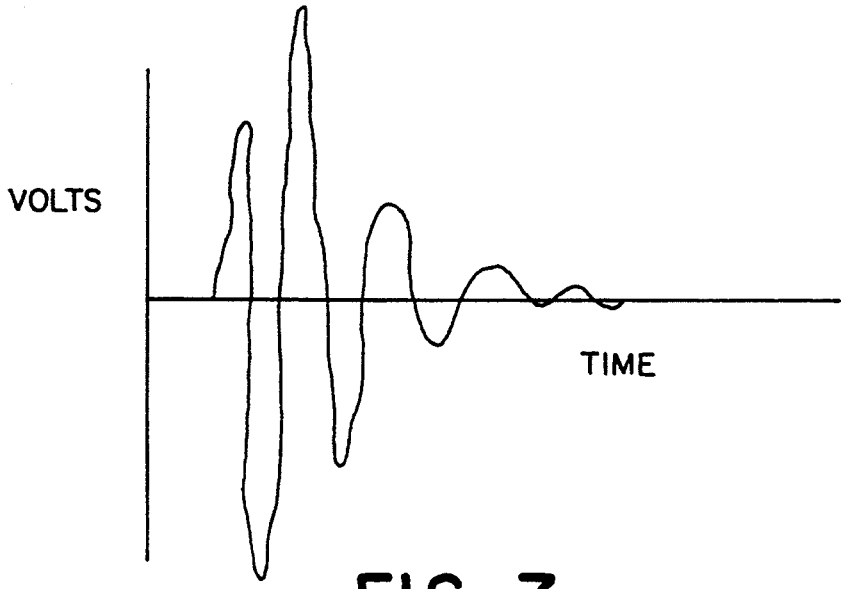
FIG. 7 is a diagrammatic representation of a typical three lobe signal resulting from a resonating security tag.

In DSP2, software is employed as a means to analyze each resultant frame in accordance with predetermined criteria and pattern recognition techniques based upon receiver output signals which would be expected if a tag were present in the detection zone in an effort to predict whether or not a tag 12 is actually present in the detection zone of the EAS system 10. The presence of a tag 12 results in a characteristic tag signal at a frequency of about 8.2 MHz on both the transmitter upsweep (sample 64) and on the transmitter downsweep (sample 192). The characteristic tag signature signal is a known signal as illustrated in FIG. 7 and includes characteristics such as three primary lobes two below the axis and one above the axis, predictable zero crossings, predictable pulse widths and signal energies, etc. It should be appreciated that the characteristics of the tag signal are dependent upon the analog signal processing which takes place in the antenna assembly 150 and receiver 200. The present embodiment is adjustable to compensate for variations in the characteristics of the tag signal based upon receiver processing and other changing features which may vary from system to system or may vary in differing system operating environments.

Figure 8:
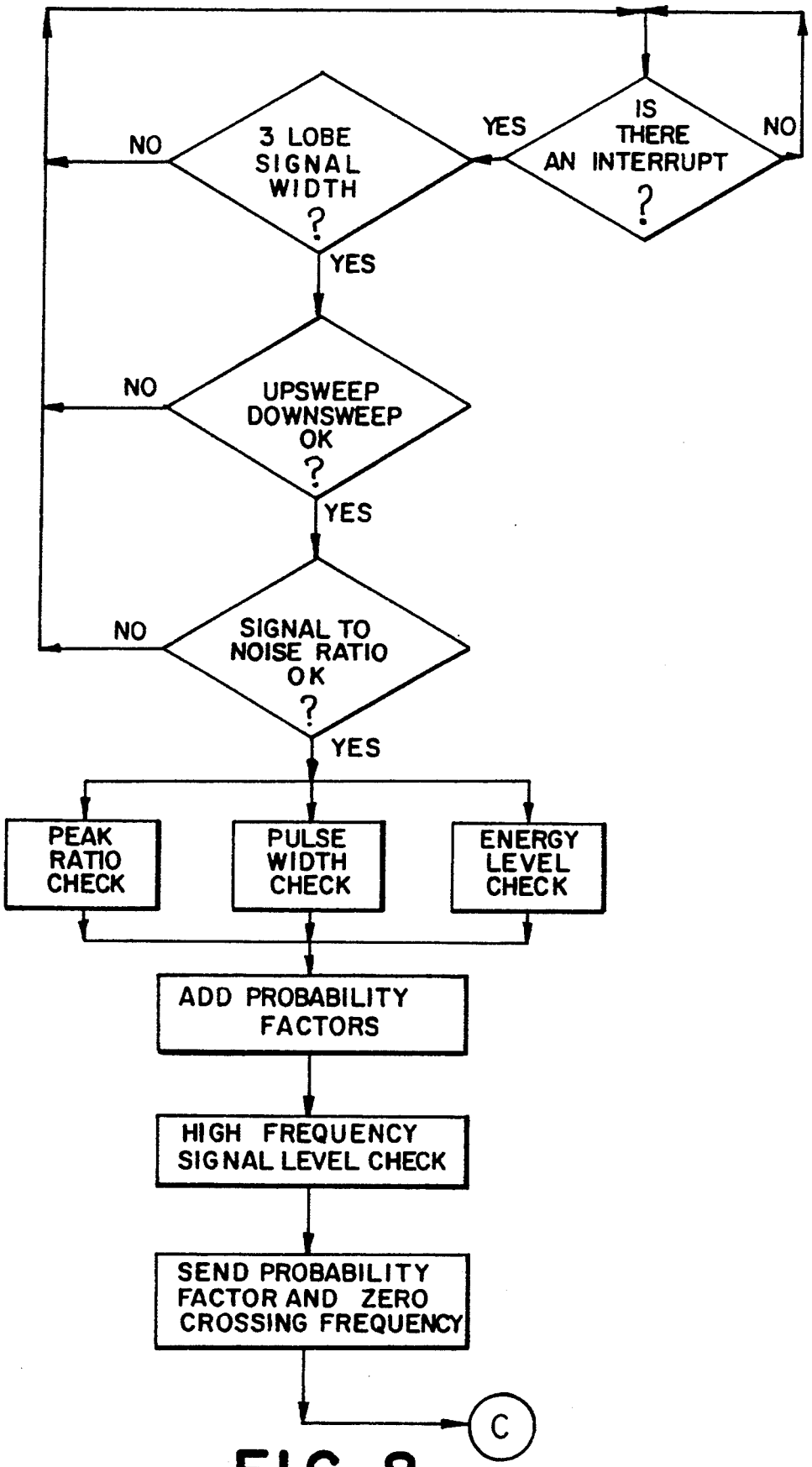
FIG. 8 is a flow diagram illustrating the functional operation of another portion of the data processing and control system of FIG. 5.

As illustrated by the flow diagram of FIG. 8, after DSP2 has been interrupted, DSP2 checks the upsweep portion of each frame between about 7.6 MHz and 8.4 MHz (samples 16–80) to determine whether the three primary lobes of a characteristic tag signature signal having an appropriate width is present in the resultant frame. Each lobe of a characteristic tag signal has a predetermined minimum and a predetermined maximum number of samples in it. If there is a three lobe signal that meets the sample number per lobe criteria, i.e., a greater number of samples than the minimum and a lesser number of samples than the maximum, a characteristic three lobe signal is said to be found. If no three lobe characteristic signal is present on the upswing portion of the frame then the analysis of the particular resultant frame is complete and the data processing and control system 300 concludes that there is no tag present in the detection zone. DSP2 then waits for the next resultant frame interrupt to perform further analysis.

If a characteristic three lobe signal width is found in the upsweep portion of the frame between about 7.6 MHz and 8.4 MHz, DSP2 checks the downsweep portion of the frame between about 8.4 MHz and 7.6 MHz (samples 176–240) to determine whether another three lobe signal having the same general lobe width, i.e., greater than the minimum but lesser than the maximum number of samples, but inverted is present at or about the corresponding mirror image sample locations. If no such second three lobe characteristic signature signal is present on the downward sweep, the data processing and control system 300 concludes that no tag is present in the detection zone with respect to the particular frame. DSP2 then waits for the next succeeding resultant frame interrupt to perform further analysis.

If a characteristic three lobe signal is found in the upsweep and downsweep portions of the frame between about 7.6 MHz and 8.4 MHz, the rectified average of the identified three lobe signal is determined and is compared to the current rectified average noise level to establish a rectified signal-to-noise ratio. If the rectified signal-to-noise ratio is less than a predetermined minimum threshold level, the data processing and control system 300 concludes that there is no tag present in the detection zone and DSP2 waits for the next resultant frame interrupt to perform further analysis.

If DSP2 determines that a characteristic tag signature signal is present in both the upsweep and the downsweep portions of the frame and the rectified signal-to-noise ratio of the signal equals or exceeds the predetermined minimum threshold level, DSP2 performs three further pattern recognition checks. In the first check, DSP2 determines the peak ratios of the amplitudes of the three primary lobes of the identified signal for both the upward sweep and the downward sweep portions. The calculated peak amplitude ratios are compared to preestablished criteria for a known tag peak amplitude ratio. For example, the ratios of the peak amplitude of the first lobe with respect to the second lobe for each three lobe signal, should be between about 0.75 and 1.25 if a tag is present within the detection zone. Correspondingly, the ratios of the amplitude of the second lobe with respect to the amplitude of the third lobe should be between 0.5 and 1.0 if a tag is present in the detection zone. A first probability percentage factor is assigned to the particular frame being analyzed depending upon the number of peak ratios of the lobes determined to be within the expected range on both the upward sweep and the downward sweep portions.

Similarly, in the second check, DSP2 analyzes the energy level of each lobe of the identified three lobe signal for both the upward sweep and the downward sweep. The lobe energy is calculated by obtaining the sum of the squared amplitude of the samples for each of the three lobes on the upward sweep and then taking the sum of the squared amplitudes of the samples of the three lobes on the downward sweep. A ratio or fraction is then made with the largest of the two results as the denominator. The resulting fraction, called the squared amplitude ratio level is compared to the number one and a second probability percentage factor is assigned to the particular frame depending upon how close the fraction is to the number one.

In the third check, DSP2 calculates the overall pulse width of the identified three lobe signal by counting the number of samples between the first zero crossing and the fourth zero crossing for both the upward sweep and downward sweep portions. The number of samples counted between the first and fourth zero crossings for the upward sweep three lobe signal is then compared with the number of samples counted between the first and fourth zero crossings for the downward sweep three lobe signal. If the difference between the counted number of samples in the upward sweep signal and the downward sweep signal is less than two, a third probability percentage factor is assigned to the frame. If the difference is greater than or equal to two a probability percentage factor of zero is assigned to the particular resultant frame.

After the performance of all of the foregoing analysis, the three probability percentage factors for the particular resultant frame are added together to provide an overall frame probability percentage which is stored for each frame in shared memory 303B. The various steps in the analysis and the corresponding probability percentage factors are weighted in different manners to take into account the degree of likelihood that each criteria indicates the presence of a tag within the detection zone. The weighting and analysis should result in a frame probability percentage near 100% if a tag is present and significantly less than 100% in the absence of a tag in the detection zone. The detection criteria employed by DSP2 may be modified and the weighting of the probability percentage factors may be changed to accommodate local conditions and/or the desires of the operator of the electronic article surveillance system. For example, in a particular location, local environmental conditions may so affect the system that, for example, the peak amplitude ratio criteria must be modified for enhanced tag detection.

The high frequency thresholds are established by setting a configurable offset from the average level of the current high frequency signal levels. The average level uses the detected high frequency signal levels from the receiver level detectors 244 and 248 which are averaged over a relatively long period of time to establish a high frequency threshold. The averaging period may be established to range from a few minutes to an entire day or longer. The received high frequency levels are filtered in DSP2 for a fast attack time on an increasing high frequency level and a slow decay time on a reducing high frequency level, giving more weight to increased high frequency levels than to reduced high frequency levels. DSP2 generates each of the high frequency thresholds and compares them to the respective filtered current high frequency levels. If either or both of the filtered current high frequency levels exceed the respective thresholds at the same time as a high tag probability percentage is determined, the overall frame probability percentage is reduced by a significant factor. In the present embodiment, the overall frame probability percentage is reduced by twenty-five percent if either threshold is exceeded and by fifty percent if both thresholds are exceeded.

DSP2 also calculates the sample number of the zero crossover point between the first and second lobes of the suspected tag signal. The zero crossover point between the first and second lobes should occur ideally at sample number 64 (8.2 MHz) for a perfect tag within the detection zone and for a perfectly tuned system 10. The sample number of the zero crossover between the first and second lobes, corresponding to the center frequency of the tag 12, is also stored in shared memory 303B for each frame.

Figure 9:
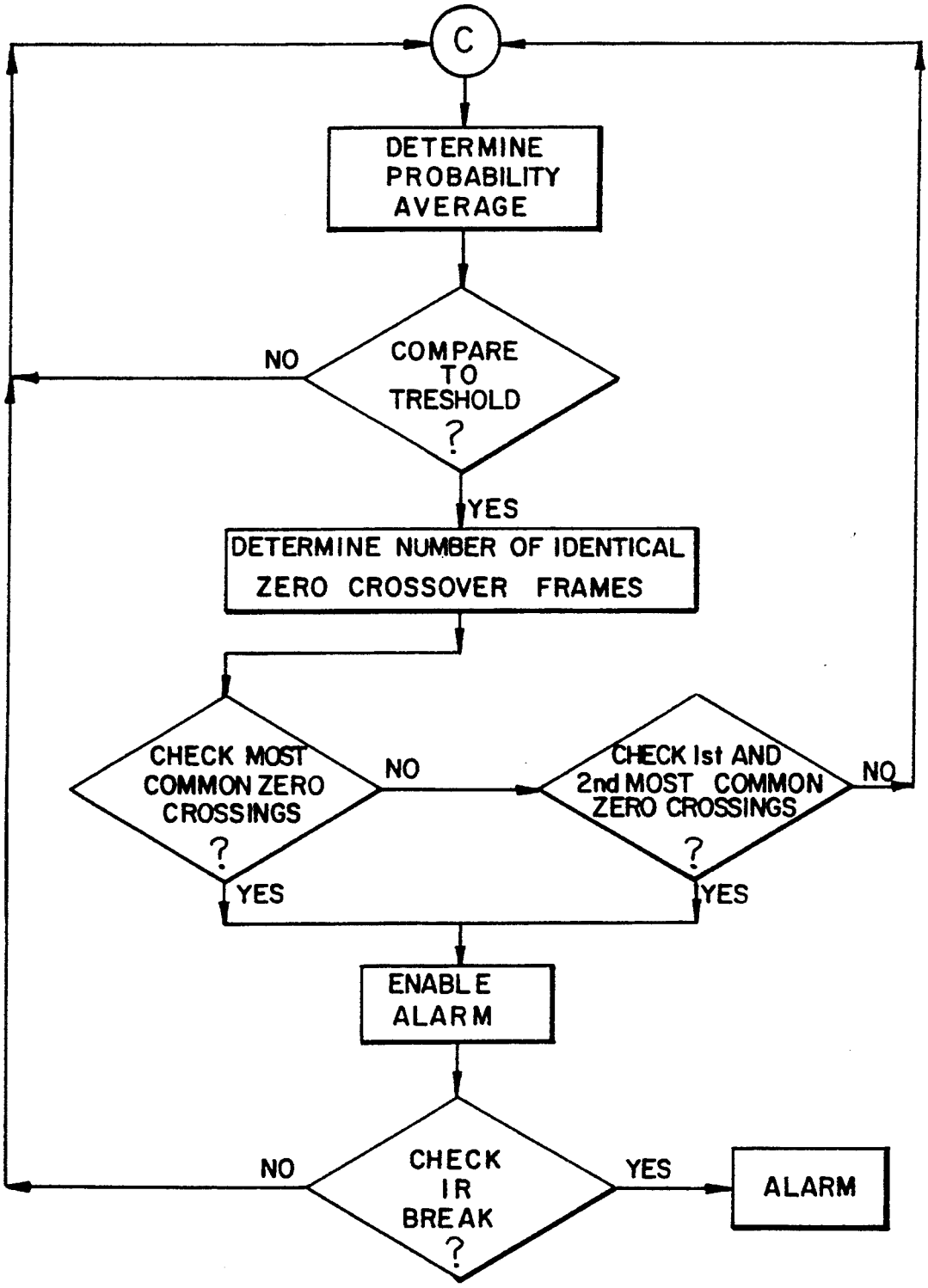
FIG. 9 is a flow diagram illustrating the functional operation of yet another portion of the data processing and control system of FIG. 5.

The resulting overall frame probability percentage and the sample number of the zero crossover point between the first and second lobes for each frame are obtained by the multi-tasking processor 302 from shared memory 303B. As illustrated in the flow diagram of FIG. 9, the multi-tasking processor 302 averages the resulting overall frame probability percentage for the present frame with the overall frame probability percentage for other frames. In the present embodiment, the average is with the past four frames to provide a five frame moving probability percentage average but a lesser or greater number of frames may be averaged. The moving five frame probability percentage average is then compared to a predetermined threshold number. The threshold number is selected to provide consistent tag detection results with minimal or no false positives. The threshold number may be varied based upon local conditions or the desires of the system operator. If the moving five frame probability percentage average is less than the predetermined threshold, then the multitasking processor 302 concludes that no tag is present in the detection zone for the current frame.

Similarly, the sample number of the zero crossover point between the first and second lobes for the current frame is compared to the zero crossover sample numbers of other frames, in the present embodiment the past four frames, to provide zero crossover data for five frames on a continually moving basis. If desired, a greater or lesser number of frames could be used. The most common zero crossover sample number and the second most common zero crossover sample number within a preestablished acceptable window are determined. Two separate comparisons are made at the same time. In the first, the most common zero crossover sample number for the past five frames is compared to a first predetermined threshold count. In the second, the sum of the first most common zero crossover sample numbers and the second most common zero crossover sample numbers over the past five frames is compared to a second predetermined threshold count. Both of the threshold counts may be varied if desired to improve/-change system performance. If the result of both comparisons is less than the respective predetermined threshold count, the multi-tasking processor 302 determines that no tag is present in the detection zone with respect to the current frame.

If the multi-tasking processor 302 determines that the five frame moving average probability percentage threshold is met or exceeded and if either or both of the two comparison results are equal to or more than the respective predetermined threshold counts for the past five frames, then an alarm condition is enabled. The effect of enabling an alarm condition is that the data processing and control system has made the determination that based upon the foregoing analysis and processing, the signal of the current frame is highly likely to include a signal that closely corresponds to a characteristic tag signal thereby strongly suggesting that a tag 12 is present within the detection zone.

Although an alarm condition is enabled, an alarm signal is not generated unless the alarm condition is enabled either at the same time or within predetermined times before or after the detection of the presence of an object (person) within the detection zone. The present invention comprises means for verifying the physical presence of an object or person in the detection zone. In the present embodiment, the verifying means comprises a pair of infrared beams extending across the detection zone although other types of verifying means could be employed if desired. If the alarm condition is enabled, the presence of an object within the detection zone, in the presently preferred embodiment, is determined by whether either or both of a pair of infrared beams is broken. The multi-tasking processor 302 determines whether an infrared beam is broken a predetermined time before the current frame or within a predetermined time after the current frame for which an alarm condition is enabled. In the presently preferred embodiment, an alarm signal is generated only if an alarm condition is enabled within one-half second before an infrared beam is broken or within one-half of a second after an infrared beam is broken.

Figure 10:
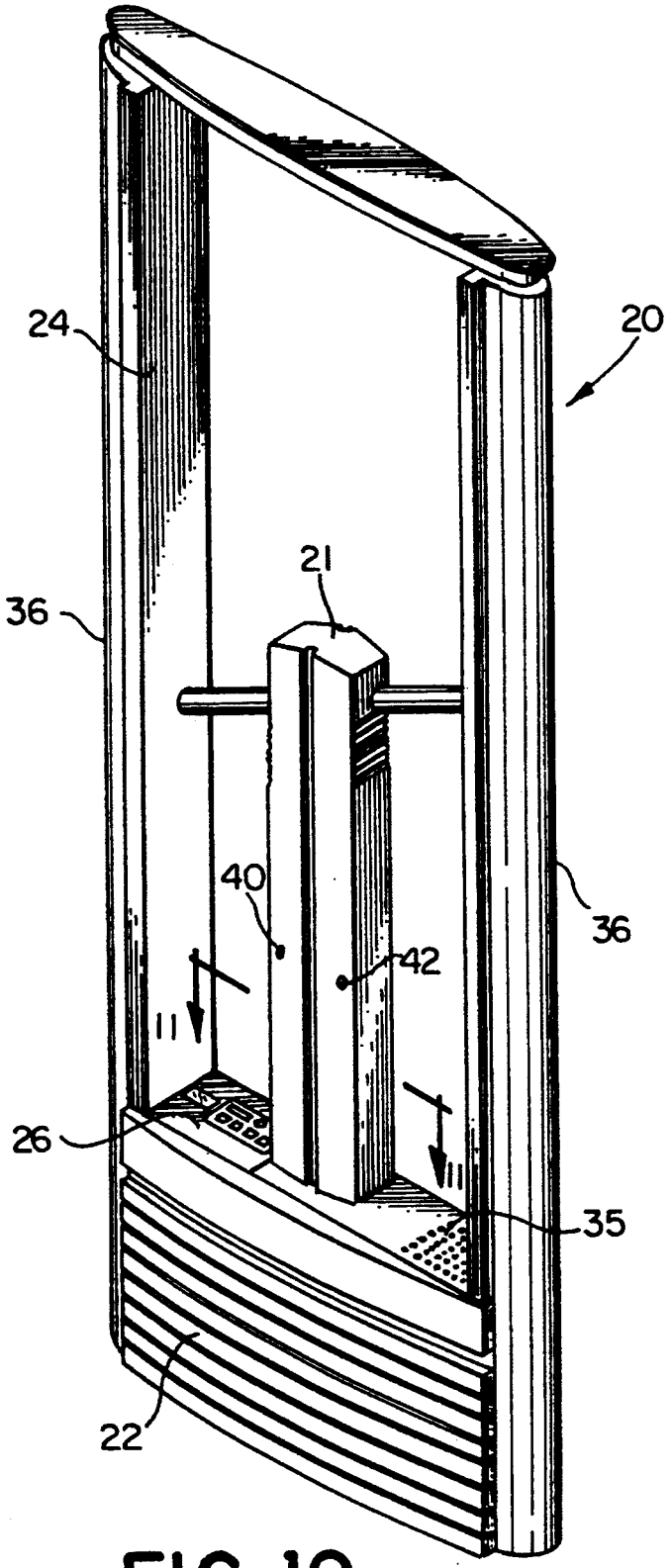
FIG. 10 is a perspective view of a preferred embodiment of the housing of the electronic article security system of FIG. 1.

As shown in FIG. 10, the presently preferred embodiment of the EAS system 10 of the present invention is contained within a single housing or pedestal 20. The pedestal is formed of a lower portion or base 22, a generally tubular upper portion 24 extending upwardly from both ends of the base 22 to a predetermined height and a central support member 21 extending upwardly from the middle of the base 22. The tubular portion 24 contains the antenna assembly 150, specifically the antenna loops 152, 154, and may be formed of any suitable material, such as an extruded polymeric material or a metallic material of the type well known in the EAS art. It will be appreciated by those skilled in the art that the actual shape and aesthetic or ornamental appearance of the tubular portion may vary from what is shown in FIG. 10. Preferably, the tubular portion 24 has an aesthetically pleasing appearance and may include slots, tabs, lugs or the like for attaching suitable signs on customized display panels if desired.

The base 22 contains printed circuit boards and other electrical and electronic circuitry necessary for the operation of the EAS system 10, including the transmitter 100, receiver 200, digital processing and control system 300, communications circuitry, etc. Preferably, the base 22 is formed from a relatively high strength, lightweight material such as a polymeric material, steel, aluminum, or the like. It should be clearly understood by those skilled in the art that any other suitable material may be employed for forming the base 22.

Figure 11:
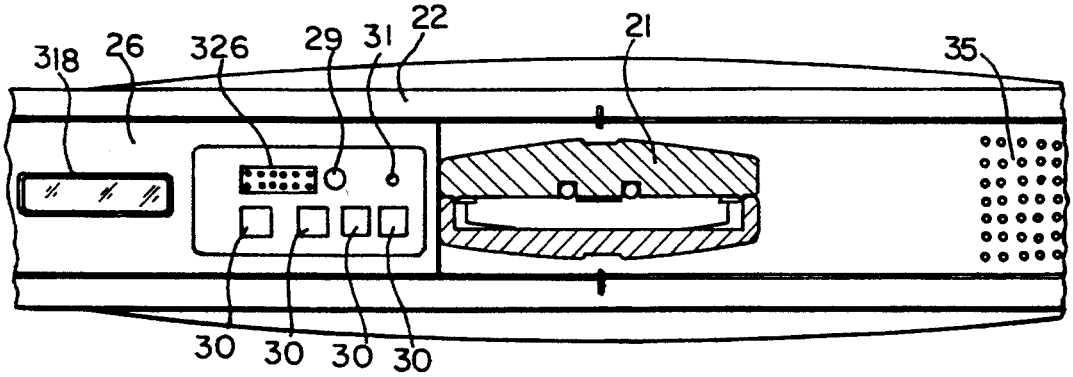
FIG. 11 is a partial sectional view taken along line 11—11 of FIG. 10 illustrating a preferred embodiment of the front panel of the electronic article security system of FIG. 1.

The base 22 includes a front panel 26 best shown in FIG. 11. The front panel 26 includes a small display panel or display screen 318, a plurality of control switches 30, a reset switch 31, and a suitable connector, in the present embodiment, an RS 232 connector 326. In the present embodiment, the display screen 318 is a 2×16 liquid crystal display of a type well known in the art and generally commercially available from a number of suppliers. The display screen 318 is thus capable of displaying two lines of 16 characters each, preferably the characters which are displayed on the display screen 318 are ASCII characters. It will be appreciated by those skilled in the art that the size and type of the display screen 318, as well as the type of characters displayed on the display screen, may be varied, if desired. The display screen 318 is employed for displaying output information for a user regarding the status of the EAS system 10 and to facilitate servicing or reprogramming of the electronic article surveillance system 10 utilizing menu driven software in a manner which will hereinafter become apparent. A display adjustment knob 29 is provided on the front panel 26 for controlling the visibility of the display screen 318.

In the presently preferred embodiment, the switches 30 on the front panel 26 comprise four pushbutton type switches which, when depressed or released, allow a user to communicate with the EAS system 10 and more particularly, with the digital processing and control system 300 and a reset switch 31, which is also of the push-button type, but is smaller than the other switches 30. Each of the four push-button switches 30 are employed in connection with the display screen 318 to perform particular user friendly menu driven software functions in connection with the programming, reprogramming, testing, monitoring, or adjusting of the EAS system 10.

The connector 326 is provided to permit communication between the EAS system 10 and some other electronic device, such as a computer (not shown). Thus, a portable or other computer located proximate the pedestal 20 may be connected directly to the digital processing and control circuitry 300 of the EAS system 10 through the connector 326 to facilitate downloading of data for remote analysis or report printing as well as to permit programming, reprogramming, testing, monitoring or adjusting of the electronic article security system by the computer. Alternatively, connector 326 or connector 328 (using a converter) may be connected to a suitable modem (not shown) and communication system 550 through a remotely located computer (not shown) to accomplish the same purposes. In this manner, new software which is developed or modifications to the existing software may be installed within the EAS system 10 without having to open the base 22 or otherwise disassemble the system in any manner. In addition, on-site or remote monitoring of the operation of the electronic article security system may be accomplished utilizing the connector 326. If desired, the RS485 connector 328 (FIG. 5) which is located within the base 22, may be employed for the same purposes.

An alarm indicator lamp or light 320 is located on at least one end and in the present embodiment on both ends of the pedestal 20. The alarm indicator lights 320 (FIG. 5) include suitable bulbs (not shown) as well as a timing device (not shown) for flashing the bulbs on and off at a predetermined rate. The alarm indicator lights 320 further includes clear or translucent casings 36 on the distal ends of the pedestal 20 which channel the light provided by the bulbs during an alarm condition along a substantial portion of the ends of the pedestal 20 for ease of recognition. Suitable omni directional reflectors (not shown) at the top of each end of the pedestal 20 reflect the light outwardly in all directions. It will be appreciated by those skilled in the art that additional alarm indicator lights may be provided in other locations, if desired (for example, on the upper middle portion of the pedestal 20).

While the present invention preferably employs alarm indicator lights 320, an audible alarm (not shown) may be used either in conjunction with the indicator lights 320 or instead of the indicator lights. The front panel includes a suitable grill 35 to facilitate the release of audio output signals from the speaker 334 (FIG. 5). The audible alarm may include a continuous tone or series of tones having different frequencies, an intermittent tone or series of intermittent tones, or a voice alarm, such as a pre-recorded message which is obtained from stored messages available in the VFROM 313. Audio alarm messages may be stored in the VFROM using procedures and techniques known to those skilled in the art. In addition, in the present embodiment, such audio alarm messages may be entered utilizing an audio signal, for example, from a tape recorder or microphone, which is connected to the receiver 200 at a point prior to the limiter 234 under control of the processor 302. Alternatively, the audio alarm messages could be entered through either of the connectors 326 or 328.

Alternatively, a remote alarm may be provided at some other location, for example, a back room of a store or facility. The present embodiment includes a pair of relays 327, each of which includes at least one set of normally open contacts and at least one set of normally closed contacts. The flow of current to the coils of each of the relays 327 is controlled by the processor 302. In the presently preferred embodiment, the processor 302 provides current to the coils of both relays 327 upon the occurrence of an actual alarm. The application of current to the coils of the relays 327 changes the state of each of the relay contact sets. The changing state of the contact sets of the relays 327 may be used at a remote location to activate or deactivate an indicator device such as a bell, buzzer, siren, light, etc. (not shown) to alert appropriate security or other personnel of the occurrence of an alarm or to activate other equipment, such as a still or video camera.

As previously stated, the EAS system 10 does not generate an alarm unless an alarm condition is enabled and either or both of a pair of infrared beams is broken within a predetermined time before or after the alarm condition is enabled. The infrared beams are generated by infrared transmitter means, in the present embodiment a pair of infrared transmitters (not shown) located within the pedestal 20 and, preferably, within the central support member 21 at a predetermined height. In the presently preferred embodiment, the predetermined height is approximately one-third of the overall height of the pedestal. The infrared beams are transmitted out of each lateral side of the pedestal 20 and into the detection zone through two suitably sized beam transmitter openings 40 (only one shown in FIG. 10) which are provided on both lateral sides of the support member 21. In the presently preferred embodiment, both of the infrared beam transmitter openings 40 are at approximately the same height which, in the presently preferred embodiment, is approximately one-third of the height of the pedestal 20. It will be appreciated by those skilled in the art that the infrared beam transmitters and the infrared beam transmitter openings 40 may be located at different heights from one another and at different heights with respect to the pedestal 20, if desired.

Infrared receiver means, in the present embodiment a pair of infrared beam receivers (not shown) are also located at a predetermined height within the central support member 21. The infrared beam receivers are provided to receive and demodulate or decode infrared beams received through two suitably sized beam receiver openings 42 (only one shown in FIG. 10) which are provided on both lateral sides of the support member 21. In the presently preferred embodiment, the infrared receivers are located at about the same height as the infrared transmitters and the infrared receiver openings 42 are at about the same height as the infrared beam transmitter openings 40. In the present embodiment, the beam transmitter openings 40 are spaced from the infrared receiver openings 42 by about four to six inches but the distance may be varied, if desired. Also in the present embodiment, the beam transmitter opening 40 on each lateral side of the pedestal 20 is generally aligned with the infrared receiver opening 42 on the opposite lateral side of the pedestal 20 in a standardized manner so that the infrared beams pass through the detection zone to the receivers. More particularly, assuming that the lateral side of the pedestal 20 shown in FIG. 10 is the first side, the beam transmitter opening 40 on the second side (not shown) is generally aligned with infrared receiver opening 42 and the infrared receiver opening 42 on the second side (not shown) is generally aligned with the beam transmitter opening 40 on the first side.

When two EAS systems 10 are employed in the second mode of operation in a side-by-side relationship as schematically illustrated by FIG. 12, the pedestals 20, 20' are positioned with the detection zone therebetween and are aligned such that one of the infrared beams transmitted from one pedestal 20 on a first side of the detection zone is received at the other pedestal 20' on a second side of the detection zone and vice versa. Essentially, the pedestals 20, 20' are positioned in the same orientation so that the first lateral side **20*a* of one pedestal 20 faces the second lateral side 20'*b* of the other pedestal 20' such that the infrared beam openings 40, 42 on each of the pedestals are aligned with each other. In this manner, a single infrared beam is transmitted from each pedestal 20, 20' and a single infrared beam is received by each pedestal from the other pedestal for providing a beam extending through the detection zone in each direction as shown by the flow arrows on FIG. 12**.

When the EAS system 10 is employed as a single unit, suitable reflector means or reflectors 19 may be appropriately positioned on the opposite side of the detection zone from the pedestal 20 to reflect transmitted infrared beams passing through the detection zone back to the infrared receivers on each lateral side of the pedestal through the infrared beam openings 40, 42. Similarly, when two pedestals 20, 20' are employed, reflectors 19 may be used to reflect the transmitted infrared beams from the outer sides (i.e., the lateral sides of the pedestals **20*b*, 20'*a*** not facing each other) to the infrared receivers on the same lateral sides. The same type of arrangement may be employed when three or more pedestals are used in the third mode of operation. As long as each of the pedestals are oriented in the same manner (i.e., the first or "a" side of each pedestal facing the second or "b" side of the adjacent pedestal and, when desired for increased protection area with reflectors for the outer or end two pedestals) and are properly aligned, any number of pedestals may be employed.

The infrared beams are modulated to pass encoded control signals and data between adjacent pedestals 20, 20'. The infrared beam transmitted from the first lateral side **20*a* of each pedestal is modulated utilizing a first code convention and the infrared beam transmitted from the second lateral side 20*b* of each pedestal is modulated using a second code convention which is different from the first code convention, more particularly the code conventions are orthogonally unique from each other. For example, the first code convention could transmit a digital "1" and a digital "0" utilizing the pulse configuration shown in FIGS. 13*a* and 13*b* and the second code convention could transmit a digital "1" and a digital "0" as illustrated in FIGS. 13*c* and 13*d*. In this manner, it is possible to distinguish between the two infrared beams so that if two beams are broken in rapid succession, the EAS system 10 can identify the order in which the beams are broken. This facilitates determination of object flow direction through the detection zone (i.e., in or out). It is also possible to have two infrared beams generally parallel to each other in close proximity with minimal interference between any data passing along the beams. In addition, the EAS system 10 can determine whether a received infrared beam is from another pedestal or merely a reflection of its own transmitted infrared beam. Preferably, the data transmitted comprises ASCII characters with a modulation frequency of 600 Hz with a carrier of 38 KHz, but any type of data and any modulation frequency may be used in the alternative. The data transmitted between adjacent pedestals may be used by the EAS system 10** for communication purposes to enhance system performance, for example, for passing alarm data between systems. It will be appreciated by those skilled in the art that the manner in which the infrared beams function may have many other applications beyond the EAS field.

As previously discussed, the breaking of at least one of the infrared beams by an object (person) within the detection zone results in a verification signal due to one of the infrared receivers not receiving an infrared beam which is required in order to generate an alarm. The EAS system 10 also utilizes the breaking of the infrared beams to count the number of objects or people passing through the detection zone. Because the infrared beams are spaced apart by a predetermined distance and transmit differently encoded data as described above, the EAS system 10 is also able to determine whether a person passing through the detection zone is moving into the facility or out of the facility depending upon the order in which the infrared beams are broken. Such total count and directional count information is stored in the memory of the EAS system 10 along with elapsed time and other timing information and may be made available to the user of the system, either on an hourly, daily or other basis, in order to provide an assessment of facility traffic. Such count information can be displayed on the display screen 318 under control of the panel switches 30 or may be output through either of the connectors 326, 328.

Whenever two or more EAS systems 10 are employed together, there is a likelihood that a tag 12 passing within a detection zone between the systems could result in the generation of an alarm condition in both systems. With the present invention, when all of the conditions are present for an alarm in an EAS system, the system communicates to the other systems in the vicinity (through the RS 485 connector 328 or through the infrared beams) that it is going to alarm. The other systems which are so notified are effectively deactivated for the duration of the alarm and thereafter are reactivated. In the presently preferred embodiment, the deactivation period is determined by the alarm duration selected by the user through the front panel switches 30. However, it will be appreciated that a shorter or a longer deactivation period may be used depending on the particular EAS application, operating environment, and other factors. In addition, whenever three or more EAS systems 10 are employed together, this feature permits the identification of a more specific location of a security tag 12 within the detection zone: i.e., to a first side or a second side of a particular pedestal. This result is accomplished by identifying the first pedestal to detect the security tag 12 and the second pedestal to detect the security tag. The security tag 12 would be closer to the first detecting pedestal but on the same lateral side as the second detecting pedestal.

The electronic article security system of the present invention also includes an auto tune feature which may be initiated by a user or service personnel utilizing the front panel switches 30 or may be programmed to be activated at periodic intervals; for example, once every five minutes, once per hour, once per day, upon daily start-up of the system, etc. In employing the auto tune feature, the processor 302 activates the simulated tag 323, in the present embodiment a tuned circuit within the detection zone of the EAS system 10 which results in the generation of a simulated tag signal with a center frequency of about 8.2 MHz to emulate the presence of a tag within the detection zone. Upon receipt of the 8.2 MHz simulated tag signal, the processor 302 adjusts its above-described identification parameters. The auto tune feature provides for enhanced detection of a tag 12 within the detection zone and improves the ability of the EAS system 10 to avoid false positives. In multiple system operations, the auto tune feature temporarily disables and then reenables the other EAS system during the auto tuning process.

The EAS system 10 is also adapted for cooperating with other related equipment. For example, the EAS system 10 includes a blanking feature which effectively blocks the processor 302 from alarming for a predetermined time when the EAS system 10 is operating in connection with a slaved deactivation unit (not shown). Typically, such deactivation units transmit energy at or near the tag frequency and at a sufficiently high level to deactivate a tag by short circuiting a portion of the tag circuitry. The blanking period is generally long enough to avoid interference between the EAS system 10 and the signal generated by a security tag being deactivated by the deactivation unit which would have been caused by the presence of RF energy from the deactivation unit causing the security tag to resonate and generate a characteristic three lobe signal during deactivation. In the presently preferred embodiment, the blanking period is determined by the length of time that the deactivation unit is activated to disable a security tag plus a predetermined guard time which in the present embodiment is 1.5 seconds. In the presently preferred embodiment, the blanking period is controlled by the processor 302 and may be varied, if desired. Prior to the EAS system 10 generating an actual alarm, the system pauses for a predetermined time period and checks for the presence of a blanking signal from, for example, a deactivating unit. In the presently preferred embodiment, the predetermined time period is ten milliseconds but the time period may be varied or eliminated by a user, if desired. If no blanking signal is detected during the time period, then the alarm signal is activated.

It will be appreciated by those skilled in the art that the digital processing and control system 300, in addition to controlling the overall operation of the EAS system 10, keeps track of the operation of the system, including alarm conditions and other operational features. More specifically, data and time information concerning alarm events is stored in the RAM 311. Alarm condition data can be remotely accessed and gathered from the RAM 311 through the display screen 318 utilizing the front panel switches 30. In addition, alarm data and other data can be obtained Utilizing either of the input/output connectors 326, 328 and may be manipulated by another computer (not shown) for the purpose of generating reports and providing complete status and operational information to a system user.

From the foregoing description, it can be seen that the present invention comprises an EAS system which provides enhanced tag detection and improved rejection of false positives resulting in a larger detection zone. It will be recognized by those skilled in the art that changes may be made to the above-described embodiment of the invention without departing from the broad inventive concepts thereof. It is understood, therefore, that this invention is not limited to the particular embodiment disclosed, but is intended to cover any modifications which are within the scope and spirit of the invention as defined by the appended claims.

We claim:

1. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, wherein the transmitter means comprises:

a controlled oscillator for receiving control signals from the data processing and control means and for generating electromagnetic output signals which vary in frequency over a predetermined frequency range at a predetermined rate as established by the control signals;

driver means for receiving the oscillator output signals and for sending the oscillator output signals along a predetermined transmission path;

transmission path receiver means connectable to the transmission path for receiving the oscillator output signals; and amplifier means connected to the transmission path receiver means for receiving and amplifying the oscillator output signals to provide the electromagnetic energy emitted by the antenna means.

2. The EAS system as recited in claim 1, wherein the driver means comprises a fiber optic driver, the transmission path comprises a fiber optic cable, and the transmission path receiver means comprises a fiber optic receiver.

3. The EAS system as recited in claim 2, wherein the fiber optic driver includes two outputs, each of which is connected to a fiber optic cable.

4. The EAS system as recited in claim 3, wherein both of the fiber optic cables are precisely the same length so that oscillator output signals at the distal ends of each of the fiber optic cables are at precisely the same phase.

5. The EAS system as recited in claim 4, wherein the distal end of one of the fiber optic cables is connected to the fiber optic receiver and the distal end of the other fiber optic cable is connected to a fiber optic receiver of a second EAS system so that the same oscillator output signal is provided to both fiber optic receivers to permit both EAS systems to operate in a master/slave relationship.

6. The EAS system as recited in claim 1, wherein the driver means comprises a wire driver, the transmission path comprises a wire, and the transmission path receiver means comprises a wire receiver.

7. The EAS system as recited in claim 1, wherein the driver means comprises a fiber optic driver and a wire driver, each of which receives the oscillator output signals.

8. The EAS system as recited in claim 7, wherein the transmission path receiver means comprises a fiber optic receiver and a wire receiver, the system further comprising selector means for selectively connecting the amplifier means to either the fiber optic receiver or the wire receiver.

9. The EAS system as recited in claim 1, further comprising a master fiber driver including a controlled oscillator for generating electromagnetic output signals which vary in frequency over a predetermined frequency range at a predetermined controlled rate, the master fiber driver including a plurality of outputs, each output being connected to one of a plurality of fiber optic cables, the distal ends of each of the fiber optic cables being connectable to fiber optic receiver means of the EAS system and of other EAS systems to provide the same oscillator output signal to all of the EAS systems to permit the EAS systems to operate in the same general area without unduly interfering with each other.

10. The EAS system as recited in claim 9, wherein all of the fiber optic cables are precisely the same length so that the oscillator output signals at the distal ends of each of the fiber optic cables are at precisely the same phase.

11. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, wherein the receiver means comprises:

a first balanced mixer for receiving and mixing together signals from the antenna means and signals from the transmitter means to establish first detected signals;

a second balanced mixer for receiving and mixing together signals from the antenna means and phase shifted signals from the transmitter means to establish second detected signals which are out of phase with respect to the first detected signals; and a sum/difference circuit for receiving the first and second detected signals from the mixers and, in a controlled manner, obtaining either the sum of or the difference between the detected signals.

12. The EAS system as recited in claim 11, wherein the signals from the transmitter means to the second mixer are phase shifted by 90°.

13. The EAS system as recited in claim 11, wherein the electromagnetic energy output from the transmitter means varies in frequency over a predetermined frequency range at a predetermined rate and wherein the operation of the sum/difference circuit is controlled by the variations in the frequency of the transmitter means.

14. The EAS system as recited in claim 13, wherein the sum/difference circuit obtains the sum of the detected signals from the two mixers when the output from the transmitter means is increasing in frequency.

15. The EAS system as recited in claim 14, wherein each of the detected signals from the mixers are low pass and high pass filtered prior to being received by the sum/difference circuit.

16. The EAS system as recited in claim 11, further including:

a bandpass filter for filtering the first detected signals to eliminate portions of the first detected signals which are outside of the band of the filter; and a level detector for receiving the portions of the first detected signals passed by the bandpass filter and for determining the average amplitude level of the received signal portions.

17. The EAS system as recited in claim 16, wherein the bandpass filter passes frequencies between 10.5 KHz and 13.5 KHz.

18. The EAS system as recited in claim 16, wherein the bandpass filter passes frequencies between 19 KHz and 22 KHz.

19. The EAS system as recited in claim 16, further comprising a multiplexer for receiving the output from the sum/difference circuit and the output from the level detector and multiplexing the received signals.

20. The EAS system as recited in claim 19, wherein the output from the multiplexer is fed to an analog to digital converter.

21. The EAS system as recited in claim 11, wherein the output from the sum/difference circuit is fed to an analog to digital converter.

22. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone. receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising:

a first filter for performing shorter term filter averaging of output signals from the receiver means;

a second filter for performing longer term filter averaging of output signals from the receiver; and subtraction means for subtracting the results of the second filter from the results of the first filter to provide resultant signals with reduced random or transient noise, reduced correlated or environmental noise and enhanced signal to noise ratios.

23. The EAS system as recited in claim 22, further comprising analog to digital converter means for converting the output from the receiver means into digital form.

24. The EAS system as recited in claim 23, wherein the output signals from the receiver are grouped into a series of frames, each frame being of a predetermined length and containing a predetermined number of digital samples.

25. The EAS system as recited in claim 24, wherein the transmitter means generates electromagnetic energy which varies in frequency over a predetermined frequency range at a predetermined sweep rate and wherein the length of each frame generally corresponds to the period of each transmitter means frequency sweep.

26. The EAS system as recited in claim 25, wherein the beginning of each frame coincides in time with the beginning of each sweep cycle of the transmitter means.

27. The EAS system as recited in claim 24, wherein the first filter is a finite response filter which continuously filters on a one-to-one basis samples of each frame with corresponding samples of a predetermined number of immediately preceding frames to provide a constant multi-frame moving multi-sample filtered response.

28. The EAS system as recited in claim 27, wherein the predetermined number of immediately preceding frames is 31.

29. The EAS system as recited in claim 27, wherein the number of samples averaged is 128 per frame.

30. The EAS system as recited in claim 24, wherein the second filter is an infinite response filter which continuously filters on a one-to-one basis samples of each frame with corresponding samples of preceding frames to provide a multi-frame, multi-sample filtered response.

31. The EAS system as recited in claim 30, wherein the number of preceding frames is infinite and the weight of each preceding frame is continuously lowered such that the contribution of a particular frame is negligible over time.

32. The EAS system as recited in claim 30, wherein the number of samples filtered is 128 per frame.

33. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising:

means for analyzing the output signals from the receiver in accordance with predetermined criteria and pattern recognition techniques based upon receiver output signals which would be expected if a security tag were present in the detection zone and for establishing for the receiver output signals a security tag probability percentage.

34. The EAS system as recited in claim 33, further comprising analog to digital converter means for converting the output signals from the receiver into digital form.

35. The EAS system as recited in claim 34, wherein the transmitter means generates electromagnetic energy which varies in frequency over a predetermined frequency range, the frequency being swept upwardly and downwardly within the frequency range at a predetermined sweep rate and wherein the analog to digital converter means is synchronized with the frequency sweep of the transmitter means to group the digitized receiver output signals into a series of frames, each frame containing a predetermined number of digital samples and each frame having a length corresponding to the period of the frequency sweep of the transmitter means so that one-half of the samples of each frame correspond to the upward sweep of the transmitter means frequency and the other half of the samples of each frame correspond to the downward sweep of the transmitter means frequency.

36. The EAS system as recited in claim 35, wherein the digitized output signals from the receiver are analyzed on a frame by frame basis to provide a security tag probability percentage for each frame.

37. The EAS system as recited in claim 36, wherein the upsweep portion of each frame is analyzed to determine whether a three lobe signal having a duration which exceeds a predetermined minimum number of samples but does not exceed a predetermined maximum number of samples is present to indicate the possible presence of a security tag in the detection zone.

38. The EAS system as recited in claim 37, wherein, if a three lobe signal having a duration which exceeds the predetermined minimum number of samples but does not exceed the predetermined maximum number of samples is present within the upsweep portion of a frame, the downsweep portion of the frame is analyzed to determine whether a three lobe signal having generally the same duration as the three lobe upsweep signal is present to indicate the possible presence of a security tag in the detection zone.

39. The EAS system as recited in claim 38, wherein, if a three lobe signal having a duration which exceeds the predetermined number of samples but does not exceed the predetermined maximum number of samples is present in both the upsweep and the downsweep portions of the frame, the rectified average of the three lobe signal is determined and is compared to the rectified noise level of the frame to establish a rectified signal to noise ratio for the frame which must exceed a predetermined minimum threshold level to indicate the possible presence of a security tag in the detection zone.

40. The EAS system as recited in claim 36, wherein each frame of digitized receiver output signals is analyzed utilizing at least one of the following:

(a) comparing the duration of a three lobe signal in the upsweep portion of the frame to predetermined minimum and maximum criteria;

(b) comparing the duration of a three lobe signal in the downsweep portion of the frame to predetermined minimum and maximum criteria;

(c) determining a rectified signal to noise ratio in a three lobe signal within a frame and comparing the rectified signal to noise ratio to a predetermined threshold level;

(d) determining peak amplitude ratios of the lobes of a three lobe signal within the frame and comparing the peak amplitude ratios to predetermined criteria;

(e) determining the sum of the squared amplitude levels of three lobe signals within the upsweep portion of the frame and within the downsweep portion to establish a ratio which is compared to one; and (f) determining the number of samples of a three lobe signal within the upsweep portion of the frame and within the downsweep portion of the frame and determining the difference between the number of samples.

41. The EAS system as recited in claim 40, wherein all of the criteria are utilized.

42. The EAS system as recited in claim 40, wherein criteria (a), (b), and (c) must all be met or the system determines that no security tag is present in the detection zone for the frame being analyzed.

43. The EAS system as recited in claim 42, wherein a first security tag probability percentage factor is assigned to a frame depending upon the number of peak amplitude ratios which fall within the expected range of the peak amplitude ratios obtained from an actual security tag.

44. The EAS system as recited in claim 43, wherein a second security tag probability percentage factor is assigned to a frame depending upon how closely the squared amplitude level ratio corresponds to one.

45. The EAS system as recited in claim 44, wherein a third security tag probability percentage factor is assigned to a frame depending upon the magnitude of the difference between the number of samples of the three lobe signal within the upsweep portion of the frame and the number of samples of the three lobe signal within the downsweep portion of the frame.

46. The EAS system as recited in claim 45, wherein each of the security tag probability percentage factors are added together to provide an overall frame probability percentage which is compared to a predetermined threshold and, if below the threshold, the system determines that no security tag is present in the detection zone for the frame being analyzed.

47. The EAS system as recited in claim 46, further including:

a bandpass filter within the receiver means for filtering detected receiver means signals above the frequency of the security tag signals to eliminate signals outside of the band of the filter and a level detector for receiving the signals passed by the filter and determining the average amplitude level of the received signals over a predetermined time period to establish a high frequency threshold level wherein the signals from the bandpass filter for each frame are compared to the high frequency threshold and, if the high frequency threshold is exceeded, the overall frame probability percentage for the frame is reduced.

48. The EAS system as recited in claim 47, wherein the sample number of the zero crossover point between the first and second lobes of a three lobe signal is determined.

49. The EAS system as recited in claim 48, wherein the overall frame probability percentages for a plurality of frames are averaged together to provide a multiframe moving probability percentage average which is compared to a threshold number and if the moving probability percentage average is less than the threshold number, the system decides that no security tag is present for the frame being analyzed.

50. The EAS system as recited in claim 47, wherein the overall frame probability percentages for a plurality of frames are averaged together to provide a multiframe moving probability percentage average which is compared to a threshold number and if the moving probability percentage average is less than the threshold number, the system decides that no security tag is present for the frame being analyzed.

51. The EAS system as recited in claim 46, wherein the overall frame probability percentages for a plurality of frames are averaged together to provide a multiframe moving probability percentage average which is compared to a threshold number and if the moving probability percentage average is less than the threshold number, the system decides that no security tag is present for the frame being analyzed.

52. The EAS system as recited in claim 40, further including:

a bandpass filter within the receiver means for filtering detected receiver means signals above the frequency of security tag signals to eliminate signals outside of the band of the filter and a level detector for receiving the signals passed by the bandpass filter and determining the average amplitude level of the received signals over a predetermined time period to establish a high frequency threshold for the system;

comparing means for comparing the signals from the bandpass filter during each frame with the high frequency threshold;

means for assigning a security tag probability percentage factor to a frame based upon the result of the analysis of the frame; and means for reducing the assigned probability percentage factor if the high frequency signals for the frame exceed the high frequency threshold.

53. The EAS system as recited in claim 40, wherein the sample number of the zero crossover point between the first and second lobes of a three lobe signal is determined.

54. The EAS system as recited in claim 53, wherein the sample number of the zero crossover point between the first and second lobes of a three lobe signal for the frame being analyzed is compared to the sample number of the corresponding zero crossover point for a predetermined number of prior frames and the most common and second most common zero crossover point sample numbers among the compared frames are established, the most common zero crossover point sample number being compared to a first threshold count and the sum of the most common and second most common zero crossover point samples being compared to a second threshold count such that if the result of each comparison is less than the respective threshold count, the system determines that no security tag is present in the detection zone.

55. The EAS system as recited in claim 33, further including means for verifying the physical presence of an object within the detection zone and wherein the data processing and control means is precluded from generating an alarm unless the system determines that a sensed disturbance within the detection zone is caused by the presence of a security tag and the verifying means verifies the physical presence of an object within the detection zone.

56. The EAS system as recited in claim 55, wherein the system is precluded from generating an alarm unless the presence of a security tag is determined and the physical presence of an object within the detection zone is verified at substantially the same time.

57. The EAS system as recited in claim 55, wherein the verifying means comprises infrared transmitter means for transmitting an infrared beam into the detection zone; and infrared receiver means for receiving the infrared beam and for generating a verification signal when the infrared beam is not received as a result of an object within the detection zone blocking the infrared beam from being received.

58. The EAS system as recited in claim 57, wherein the infrared transmitter means is located on a first side of the detection zone and the infrared receiver is located on a second side of the detection zone so that the infrared beam passes through the detection zone.

59. The EAS system as recited in claim 57, wherein the infrared transmitter means and the infrared receiver means are located on a first side of the detection zone and a reflector means is located on a second side of the detection zone so that the infrared beam from the transmitter means passes through the detection zone and is reflected by the reflector means to the infrared receiver means.

60. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection. Zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising verification means for verifying the physical presence of an object within the detection zone independently of the detection of a security tag.

61. The EAS system as recited in claim 60, wherein the data processing and control means generates an alarm only if a sensed disturbance within the detection zone is determined to have been caused by a security tag within the detection zone and the verification means verifies the physical presence of an object within the detection zone at substantially the same time.

62. The EAS system as recited in claim 61, wherein the verification means comprises:

infrared transmitter means for transmitting an infrared beam into the detection zone; and infrared receiver means for receiving the infrared beam and for generating a verification signal when the infrared beam is not received as a result of an object within the detection zone blocking the infrared beam from being received.

63. The EAS system as recited in claim 62, wherein the infrared transmitter means is located on a first side of the detection zone and the infrared receiver means is located on a second side of the detection zone so that the infrared beam passes through the detection zone.

64. The EAS system as recited in claim 63, wherein the infrared transmitter means is part of a first EAS system and the infrared receiver means is part of a second EAS system, the detection zone located between the two EAS systems.

65. The EAS system as recited in claim 64, wherein the infrared beam is employed to pass control signals and data from the first EAS system to the second EAS system.

66. The EAS system as recited in claim 65, wherein the control signals and data are encoded for transmission along the infrared beam.

67. The EAS system as recited in claim 62, wherein the infrared transmitter means and the infrared receiver means are both located on a first side of the detection zone and a reflector means is located on a second side of the detection zone for reflecting the infrared beam from the infrared transmitter means to the infrared receiver means the infrared beam passing through the detection zone at least once.

68. The EAS system as recited in claim 60, wherein the data processing and control means generates an alarm only if the verification means verifies the physical presence of an object within the detection zone a first predetermined time period before or a second predetermined time period after the occurrence of a disturbance within the detection zone which is determined to have been caused by a security tag within the detection zone.

69. The EAS system as recited in claim 68, wherein the first and second predetermined time periods are equal to one-half of one second.

70. The EAS system as recited in claim 60, wherein the data processing and control means receives data from the verification means and stores count data of the number of objects physically present within the detection zone during a predetermined period of time.

71. The EAS system as recited in claim 70, wherein the data processing and control means includes output means for outputting the count data.

72. The EAS system as recited in claim 71, wherein the output means comprises a display screen for displaying the count data.

73. The EAS system as recited in claim 72, wherein the count data is stored on an hourly basis for each hour that the EAS system is operated.

74. The EAS system as recited in claim 72, wherein the count data is stored on a daily basis for each day the EAS system is operated.

75. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising input/output means for direct access to the data processing and control means to permit programming, reprogramming, monitoring, testing or adjusting of the data processing and control means.

76. The EAS system as recited in claim 75, wherein the input/output means comprises an RS 232 connector.

77. The EAS system as recited in claim 75, wherein the input/output means comprises an RS 485 connector.

78. The EAS system as recited in claim 75, wherein the input/output means comprises a display screen and at least one control switch.

79. The EAS system as recited in claim 78, wherein the input/output means further comprises a plurality of switches.

80. The EAS system as recited in claim 79, wherein the data processing and control system includes menu driven software such that using the display screen and the plurality of control switches a user may modify and control the operation of the EAS system.

81. The EAS system as recited in claim 75, wherein the input/output means comprises a digital to analog converter means and an analog test point adapter for connection with monitoring or testing equipment.

82. The EAS system as recited in claim 75, wherein the data processing and control means includes memory means for receiving and storing data relating to operational characteristics of the system and wherein the input/output means is employed for accessing the stored data for analysis and the generation of reports.

83. The EAS system as recited in claim 75, wherein the input/output means is connectable to a communication system to permit the data processing and control means to be programmed, reprogrammed, monitored, tested or adjusted from a remote location.

84. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising auto tune means for automatically adjusting data processing parameters to compensate for local environmental and system operational factors for enhancing the ability of the system to determine whether sensed disturbances are caused by a security tag.

85. The EAS system as recited in claim 84, wherein the auto tune means comprises a simulated security tag within the detection zone.

86. The EAS system as recited in claim 84, wherein the auto tune means is activated each time the EAS system is turned on.

87. The EAS system as recited in claim 84, wherein the auto tune means is activated at periodic intervals during operation of the EAS system.

88. The EAS system as recited in claim 84, wherein the auto tune means may be activated by service personnel to facilitate inspection and servicing of the system.

89. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising means for determining the direction of movement of a person who passes through the detection zone.

90. The EAS system as recited in claim 89, wherein the direction of movement determining means comprises:

infrared transmitter means for transmitting first and second, spaced infrared beams into the detection zone; and infrared receiver means for receiving the first and second infrared beams, the system determining the direction of movement of a person by the order in which the infrared beams are broken by a person passing through the detection zone.

91. The EAS system as recited in claim 90, wherein the infrared transmitter means is located on a first and on a second side of the detection zone and wherein the infrared receiver means is located on the first and second sides of the detection zone so that the first infrared beam passes through the detection zone in a first direction and the second infrared beam passes through the detection zone in a second direction.

92. The EAS system as recited in claim 91, wherein the first and second infrared beams are generally parallel to each other and the first direction is generally opposite the second direction.

93. The EAS system as recited in claim 92, wherein the infrared beams are encoded, the first infrared beam being encoded in a manner which is distinguishable from the manner in which the second infrared beam is encoded so that the receiver means can determine which infrared beam is being received.

94. The EAS system as recited in claim 93, wherein the infrared beams are about five inches apart.

95. The EAS system as recited in claim 93, wherein the first infrared beam is encoded in a manner which is orthogonally unique from the manner in which the second infrared beam is encoded.

96. In an electronic article security (EAS) system for detecting the presence of a security tag within a detection zone, transmitter means for generating electromagnetic energy, antenna means for emitting electromagnetic energy received from the transmitter means to establish an electromagnetic field within the detection zone and for sensing disturbances within the electromagnetic field, including disturbances resulting from a security tag within the detection zone, receiver means for processing signals from the antenna means relating to sensed disturbances and for providing output signals, and data processing and control means for analyzing the output signals from the receiver means and for determining whether a sensed disturbance within the electromagnetic field is caused by the presence of a security tag within the detection zone, the data processing and control means comprising means for communicating with other EAS systems to establish a multiple system network wherein the first EAS system in the network to determine that a sensed disturbance is caused by a security tag generates a deactivating signal to the other EAS systems in the network.

97. The EAS system as recited in claim 96, wherein the second EAS system in the network to determine that a sensed disturbance is caused by a security tag generates a deactivating signal to the other EAS systems in the network, the order in which the deactivation signals are generated establishing the location of the security tag which causes the disturbance.

98. A hi-directional infrared communication system comprising:

a first infrared transmitter means located on a first side of an area for transmitting a first infrared beam through the area in a first direction;

a second infrared transmitter means located on a second side of the area for transmitting a second infrared beam through the area in a second direction generally opposite the first direction, the first and second infrared beams being generally parallel and spaced apart a predetermined distance, the first and second infrared beams being separately distinguishable from each other;

a first infrared receiver means located on the second side of the area and generally aligned with the first infrared transmitter means for receiving the first infrared beam and for generating first output signals; and a second infrared receiver means located on the first side of the area and generally aligned with the second infrared transmitter means for receiving the second infrared beam and for generating second output signals, the first and second receiver means including detection means for determining which infrared beam is being received.

99. The system as recited in claim 98, wherein the code used for the first infrared beam is orthagonally unique from the code used for the second infrared beam.

100. The system as recited in claim 99, wherein the infrared beams are encoded to pass data across the area.

101. The system as recited in claim 100, wherein the infrared beams are spaced by a distance of about five inches.

* * * * *